US009675838B2

(12) United States Patent
Manzke et al.

(10) Patent No.: US 9,675,838 B2
(45) Date of Patent: Jun. 13, 2017

(54) EXERCISE APPARATUS

(71) Applicants: Russell C. Manzke, Madison, WI (US); Ryan Francis Crist, Cottage Grove, WI (US)

(72) Inventors: Russell C. Manzke, Madison, WI (US); Ryan Francis Crist, Cottage Grove, WI (US)

(73) Assignee: JOHNSON HEALTH TECH CO., LTD., Taichung (TW)

( * ) Notice: Subject to any disclaimer, the term of this patent is extended or adjusted under 35 U.S.C. 154(b) by 10 days.

(21) Appl. No.: 14/726,622

(22) Filed: Jun. 1, 2015

(65) Prior Publication Data

US 2016/0346596 A1 Dec. 1, 2016

(51) Int. Cl.
*A63B 22/02* (2006.01)
*A63B 21/00* (2006.01)
(Continued)

(52) U.S. Cl.
CPC ..... *A63B 22/02* (2013.01); *A63B 21/00058* (2013.01); *A63B 21/00069* (2013.01);
(Continued)

(58) Field of Classification Search
CPC ..... A63B 21/00058; A63B 21/00061; A63B 21/00065; A63B 21/00069; A63B 21/00178; A63B 21/00181; A63B 21/00185; A63B 21/02; A63B 21/04; A63B 21/0407; A63B 21/0414; A63B 21/0421; A63B 21/0428; A63B 21/0435; A63B 21/0442; A63B 21/045; A63B 21/0455; A63B 21/055; A63B 21/0552; A63B 21/0555; A63B 21/0557; A63B 21/065; A63B 21/068; A63B 21/08; A63B 21/16; A63B 21/4009; A63B 21/4023;
(Continued)

(56) References Cited

U.S. PATENT DOCUMENTS 1,766,089 A * 6/1930 Wood ..... A63B 22/02 482/54
2,017,128 A 10/1935 Frank O'Neill, Jr.
(Continued)

FOREIGN PATENT DOCUMENTS

JP WO 2013124930 A1 * 8/2013 ..... A63B 22/04

*Primary Examiner* — Loan H Thanh
*Assistant Examiner* — Gary D Urbiel Goldner

(57) ABSTRACT

The present invention relates to an exercise apparatus. The exercise apparatus includes a platform with an endless belt. The endless belt defines an exercising space above it. A restricting device has a retaining portion, a left restricting portion and a right restricting portion. The two restricting portions are elongated and flexible, such as straps. The left restricting portion is connected to a left end of the retaining portion from a left rear of the exercising space. The right restricting portion is connected to a right end of the retaining portion from a right rear of the exercising space. The restricting device maintains the retaining portion at an appropriate position to make the retaining portion naturally abut against a waist of the user for resisting forward movement of the user toward a front side of the exercising space and allowing the user to sprint or quick run on the platform.

6 Claims, 16 Drawing Sheets

(51) Int. Cl.

| | |
|---|---|
| ***A63B 23/04*** | (2006.01) |
| ***A63B 71/00*** | (2006.01) |
| ***A63B 21/04*** | (2006.01) |
| ***A63B 21/055*** | (2006.01) |

(52) U.S. Cl.

CPC ..... *A63B 21/0414* (2013.01); *A63B 21/0442* (2013.01); *A63B 21/0552* (2013.01); *A63B 21/153* (2013.01); *A63B 23/04* (2013.01); *A63B 23/047* (2013.01); *A63B 71/0054* (2013.01); *A63B 21/4009* (2015.10)

(58) Field of Classification Search

CPC ..... A63B 21/4025; A63B 21/4027; A63B 21/4033; A63B 21/4035; A63B 21/4039; A63B 21/4043; A63B 22/0046; A63B 22/02; A63B 22/0207; A63B 2022/0092; A63B 23/02; A63B 23/0205; A63B 23/0211; A63B 23/0216; A63B 23/0222; A63B 23/035; A63B 23/03516; A63B 23/04; A63B 23/0405; A63B 23/0417; A63B 23/047; A63B 23/0482; A63B 23/0494; A63B 26/00; A63B 26/003; A63B 69/0028; A63B 69/0035; A63B 69/0057; A63B 69/0059; A63B 69/0064; A63B 2069/0031; A63B 2069/0037; A63B 71/0054; A63B 2071/0063; A63B 2071/0072; A63B 2071/0081; A63B 2071/009; A63B 2208/02; A63B 2208/0204; A63B 2208/0209; A63B 2225/09; A63B 2225/093; A63B 2225/096

See application file for complete search history.

(56) References Cited

U.S. PATENT DOCUMENTS 2,623,302 A * 12/1952 Shields ..... A61B 5/18 280/233
4,659,077 A * 4/1987 Stropkay ..... A63B 21/018 482/120
4,861,021 A * 8/1989 Edwards ..... A61H 3/008 482/54
4,898,378 A * 2/1990 Edwards ..... A61H 3/008 482/54
4,960,276 A * 10/1990 Feuer ..... A63B 21/157 482/4
5,100,127 A * 3/1992 Melnick ..... A01K 15/027 119/700
5,176,597 A * 1/1993 Bryne ..... A61H 3/008 482/54
5,203,800 A * 4/1993 Meredith ..... A63B 22/02 482/51
5,234,392 A * 8/1993 Clark ..... A63B 69/0035 482/112
5,342,264 A * 8/1994 Gordon ..... A63B 21/018 482/51
5,429,563 A * 7/1995 Engel ..... A63B 21/015 482/51
D364,662 S * 11/1995 Camfield ..... D21/668
5,562,572 A * 10/1996 Carmein ..... A61H 3/00 198/779
D375,767 S * 11/1996 Camfield ..... D21/668
5,656,003 A * 8/1997 Robinson ..... A63B 23/03525 482/100
5,704,880 A * 1/1998 Amatulle ..... A63B 21/4009 482/124
5,704,881 A * 1/1998 Dudley ..... A63B 71/0009 482/43
D393,027 S * 3/1998 Chen ..... D21/670
5,733,226 A * 3/1998 Chen ..... A63B 22/001 482/51
5,941,804 A * 8/1999 Johnston ..... A63B 21/0615 482/134
6,146,315 A * 11/2000 Schonenberger ..... A63B 22/02 482/54
6,152,854 A * 11/2000 Carmein ..... A63B 22/025 198/779
6,454,679 B1 * 9/2002 Radow ..... A63B 22/0235 482/4
6,500,097 B1 * 12/2002 Hall ..... A63B 19/04 482/51
6,575,876 B1 * 6/2003 Phelps-McMillon A63B 22/0235 482/51
6,676,569 B1 * 1/2004 Radow ..... A63B 22/0235 482/4
7,699,761 B1 * 4/2010 Dieter ..... A63B 23/04 482/124
8,343,016 B1 1/2013 Astilean
8,784,230 B1 * 7/2014 Mitchell ..... A63B 69/0057 473/271
8,968,163 B1 * 3/2015 Vidmar ..... A61H 3/008 482/43
9,370,680 B1 * 6/2016 Macaulay ..... A63B 21/00181
2002/0022554 A1 * 2/2002 Borsheim ..... A63B 22/02 482/54
2003/0004038 A1 1/2003 Wroclawsky
2005/0009669 A1 * 1/2005 Harris ..... A63B 21/4009 482/69
2005/0255971 A1 * 11/2005 Solomon ..... A61H 1/0229 482/54
2006/0229170 A1 * 10/2006 Ozawa ..... A61H 1/003 482/92
2007/0083975 A1 * 4/2007 Senegal ..... A63B 21/0552 2/102
2008/0119337 A1 * 5/2008 Wilkins ..... A63B 5/00 482/130
2009/0255531 A1 * 10/2009 Johnson ..... A61F 5/24 128/99.1
2010/0204014 A1 * 8/2010 Hoffman ..... A63B 21/055 482/8
2010/0240498 A1 * 9/2010 Robinson ..... A63B 22/02 482/54
2011/0082013 A1 4/2011 Bastian
2011/0230314 A1 * 9/2011 Hoffman ..... A63B 21/055 482/51
2011/0237399 A1 9/2011 Toback
2012/0010048 A1 * 1/2012 Bayerlein ..... A63B 21/0053 482/2
2012/0018249 A1 * 1/2012 Mehr ..... A63B 69/0064 182/5
2012/0197168 A1 * 8/2012 Agrawal ..... A61H 3/008 602/19
2012/0295769 A1 * 11/2012 Pennington ..... A63B 69/20 482/54
2013/0005541 A1 * 1/2013 Robinson ..... A63B 22/02 482/54
2013/0165301 A1 * 6/2013 Thrasher-Rudd ..... A63B 7/00 482/129
2014/0011642 A1 * 1/2014 Astilean ..... A63B 22/02 482/54
2014/0011645 A1 * 1/2014 Johnson ..... A63B 21/4033 482/121
2014/0026893 A1 * 1/2014 Johnson ..... A61H 3/008 128/845
2014/0274569 A1 * 9/2014 Lewen ..... A63B 7/02 482/24
2014/0274578 A1 9/2014 Kennedy
2015/0080187 A1 * 3/2015 Beane ..... A63B 69/0064 482/51
2015/0320632 A1 * 11/2015 Vallery ..... A61H 3/008 482/69
2015/0335940 A1 * 11/2015 Johnson ..... A63B 21/1488 248/118
2015/0367171 A1 * 12/2015 Truong ..... A63B 23/0205 482/4

(56) References Cited

U.S. PATENT DOCUMENTS

| | | | | |
|---|---|---|---|---|
| 2016/0001118 | A1* | 1/2016 | Kuehne | A63B 69/0064 482/54 |
| 2016/0001119 | A1* | 1/2016 | Jue | A63B 69/0064 482/54 |
| 2016/0008650 | A1* | 1/2016 | Jue | A63B 22/02 482/54 |
| 2016/0166454 | A1* | 6/2016 | Johnson | A63B 69/0064 280/1.5 |

* cited by examiner

EXERCISE APPARATUS

BACKGROUND

1. Field of the Invention

The present invention relates to an exercise apparatus. More particularly, the present invention relates to a treadmill with a restricting device.

2. Description of the Related Art

Most treadmills are electrically powered. In operation, the endless belt on the platform of the treadmills is powered by a motor at a predetermined speed for allowing a user to walk, jog or run on the belt. Generally, the user is able to preset a program containing timing variation before exercise so that the treadmill will automatically make the speed of the treadmill become faster or slower at a predetermined point according to the aforementioned program during exercising. Additionally, during exercising, the user could make the belt to speed up or slow down through a control interface of the treadmill for allowing himself (or herself) to adjust the exercising speed or change exercise modes (e.g. from walking to jogging). Even so, for the operation of the electric treadmill, it requires the user to walk or run at a speed matching that of the belt, rather than drive the belt at the speed of the user. In short, the user cannot currently speed up or slow down the speed thereof, during walking, jogging or running on the electric treadmill, like taking outdoor exercise whenever they want to.

In general, the electric treadmills are usually used for a long period of walking or running (e.g. 20, 30 minutes or more). Moreover, in current commercial treadmills, the upper limit of the adjusting range of the belt running speed is actually up to 24 to 27 km/h; that is equal to one hundred meters just in 13~14 seconds and suitable for a short period of fast-run or sprint. Since everyone has different physical abilities, not all fast-run or spring are carried out under maximum-speed operation of the belt. No matter how speed the belt is, when the user performs sprint exercise on the treadmill, the belt is driven by the motor at high speed. Therefore, if the user's running speed cannot keep up with the belt speed, there might be an additional loading for the user. Furthermore, if the user wants to take a break or end the exercise during the sprint, the user usually has two hands grip two side handrails first, and then has two feet span the belt on two side rails. If the user wants to continue running after the break, the user would step on the belt again and keep up with the belt speed, and then the user could take the two hands away from the two side rails for free swinging. It is obvious that the aforementioned motions of the break and the continuance of running have a certain degree of difficulty and inconvenience. For the safety reason, maybe that is why many people never adjust the belt speed up to the high-speed region, even if they are able to sprint with equal speed for a short time on the ground.

Relative to the electric treadmills, nowadays there are some treadmills without electric power in the market. Instead of being powered by an electric motor, the belt is powered by the user when the user walks or runs on the treadmill to push the belt with two feet (further supplemented by inertial force of a flywheel). Generally speaking, since the belt of the non-electric treadmill is rotated by the motion of the user's two feet, the user could speed up or slow down the speed of walking, jogging or running anytime. However, the general non-electric treadmill is not suitable for sprint. The reason is that: if a user continues to improve the running speed, the forward speed corresponding to the running motion of the user (equal to the step length multiplied by step frequency) may be faster than the backward sliding speed of the belt plane such that the user would be gradually close to the front end of the treadmill. In order to keep running in an appropriate region of the belt, users will naturally restrain their running speed and thus the maximum capacity cannot be exerted, so that the desired training effect cannot be achieved.

There is one method in existence trying to solve the above problems, that is, to provide a wearing member for putting on the waist or the upper body of the user, e.g. an endless strap that is able to be put around the waist or the abdomen of the user, or a vest being able to be worn on the user's body. Moreover, an appropriate length of rope is connected between the wearing member and a holder fixed behind the platform. Thereby, when the user who wears the wearing member exercises on the non-electric treadmill, if the body moves forward to a predetermined position, the body will be pulled by the rope in the rear side (straightened) to restrict the further forward motion of the user. Therefore, the user could practice for quick running or sprint with normal running motion, and to freely slow down or accelerate again in the process of running. There is a disadvantage in the aforementioned method. It requires the user to wear the wearing member before the user exercises on the platform of the treadmill. For example, the user needs to put the endless strap around the waist, and to take off the wearing member from the body after the end of the exercise, it is bothersome for the user. Furthermore, since it needs to install a stationary frame for securing the rear end of the rope behind the platform, the whole device will occupy more space.

On the other hand, the treadmills are generally available only for aerobic exercises of walking, jogging or running, such functions are restricted. One type of exercise apparatus with both functions of treadmill and anaerobic exercise (weight training) is shown in U.S. Publication No. 2014/0274578 A1. The exercise apparatus includes a platform of an analogous non-electric treadmill. The platform has a flywheel axially mounted on one end of the front roller and a friction resistance device disposed beside the flywheel. The user can manually adjust the tightness of the resistance device through a knob driving an arcuate brake pad to press against the peripheral surface of the flywheel so as to adjust the rotation resistance of the flywheel and the front roller, namely adjusting the running resistance of the belt. In addition to walking, jogging or running, the user can adjust the resistance to a higher level for making the belt difficult to slide. Then, the user could hold the front handle with two hands, adopt a position with low center of gravity, and push the belt backward with two legs so as to simulate a training of pushing a weight forward on the ground (e.g. push sled). As general non-electric treadmills, while walking, jogging or running on the exercise apparatus, the belt needs to have an appropriate resistance depending on the usage condition. However, the friction resistance device is not easy to adjust the resistance to meet the requirement especially for low resistance. If replaced with an eddy current type resistance device, it is relatively easy to make fine adjustment, but it may not be able to provide high resistance for the weight training.

The present invention has arisen to mitigate and/or obviate the disadvantages of the conventional method. Further benefits and advantages of the present invention will become apparent after a careful reading of the detailed description with appropriate reference to the accompanying drawings.

SUMMARY

The present invention is directed to an exercise apparatus that meets the needs. The object of the present invention provides a non-electric treadmill for allowing a user to do exercise of walking, jogging or running with natural motion just like outdoor exercise, and also allowing the user to spring or quick run in the user's individual maximum capacity. Moreover, the user can directly step onto the platform for exercising and leave directly after exercise without wearing or taking off the endless strap and the vest of the prior art, it is convenient. In addition, the exercise apparatus takes up less space.

Another object of the present invention provides a non-electric treadmill for allowing a user to not only execute aerobic exercises of walking, jogging or running, but also execute a weight training that simulates a motion of pushing a weight forward. Furthermore, whether the user executes the aerobic exercises or the weight training, the user can easily adjust the exercising resistance to meet the user's requirement.

According to one aspect of the present invention, the exercise apparatus includes a platform, a left side frame, a right side frame and a restricting device. The platform has an endless belt for allowing a user to do exercise of walking, jogging or running run on the belt. The belt is driven by movement of the user. The belt defines an exercising space above. The left side frame is located at a left side of the exercising space, and has a left rear holding portion defined at a rear end of the left side frame. The right side frame is located at a right side of the exercising space, and has a right rear holding portion defined at a rear end of the right side frame. The restricting device has a retaining portion, a left restricting portion, a right restricting portion. The left restricting portion and the right restricting portion are elongated and flexible. The left restricting portion is connected between the left rear holding portion of the left side frame and a left end of the retaining portion. The right restricting portion is connected between the right rear holding portion of the right side frame and a right end of the retaining portion. The restricting device maintains the retaining portion at a height corresponding to a waist of the user to make the retaining portion substantially abut against the waist of the user for resisting forward movement of the user toward the front side of the exercising space. Furthermore, the exercise apparatus having an entrance to the exercising space at a rear end thereof for allowing the user to enter or exit the exercising space.

According to another aspect of the present invention, the exercise apparatus includes: a platform having a front roller, a rear roller and an endless belt mounted around the front roller and the rear roller for allowing a user to do exercise of walking, jogging or running run on the belt, such exercises would make the belt to be revolved; a flywheel coaxially connected to the front roller; a friction resistance device mounted beside the flywheel for allowing the user to control the rotation resistance of the flywheel and the front roller; an eddy current resistance device also mounted beside the flywheel for allowing the user to control the rotation resistance of the flywheel and the front roller; and a front frame secured to the front end of the platform, and having at least one holding portion for a user to grasp.

The reader is advised that this summary is not meant to be exhaustive. Further features, aspects, and advantages of the present invention will become better understood with reference to the following description, accompanying drawings and appended claims.

Further benefits and advantages of the present invention will become apparent after a careful reading of the detailed description with appropriate reference to the accompanying drawings.

DETAIL DESCRIPTION

Figure 1:
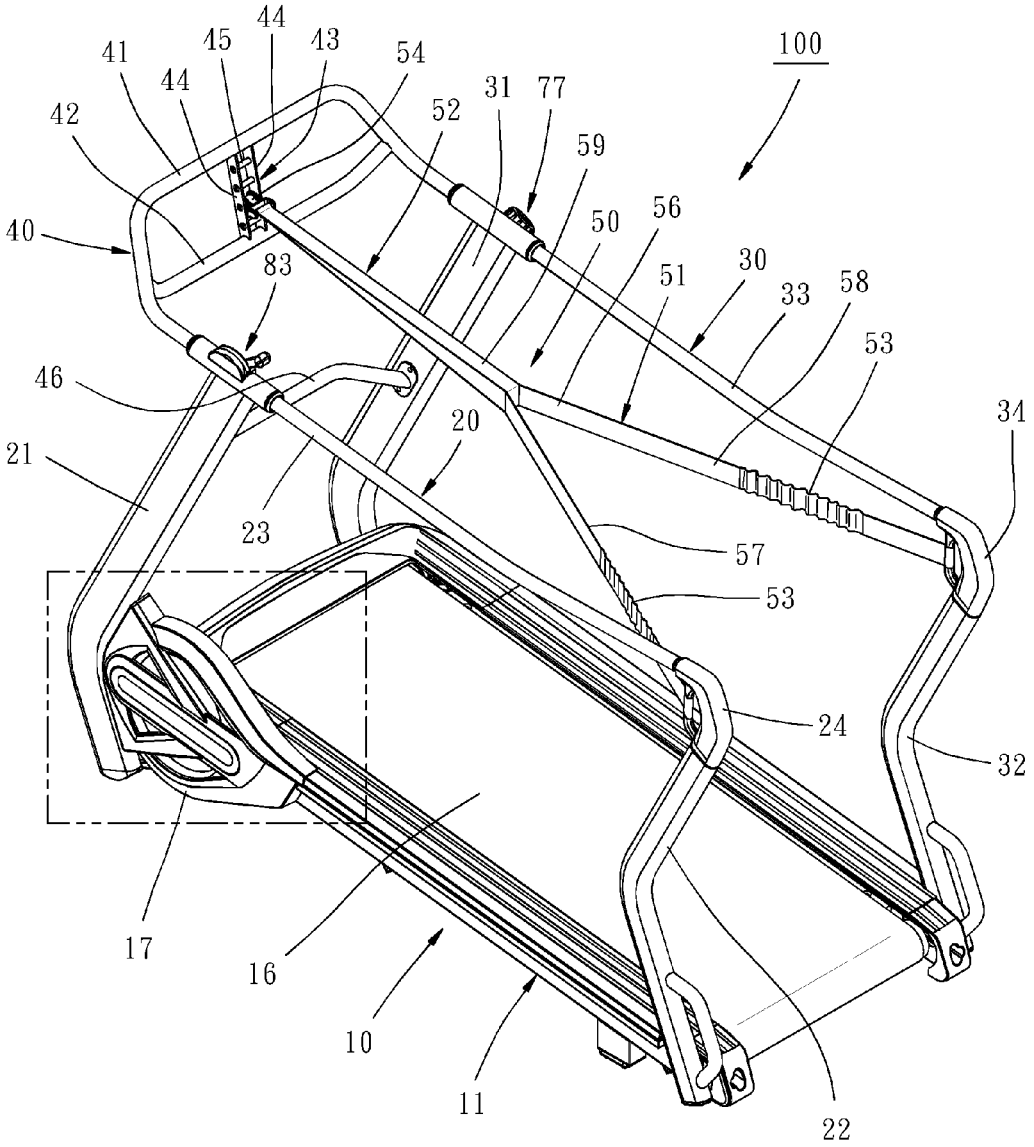
FIG. 1 is a perspective view of an exercise apparatus in accordance with a first embodiment of the present invention in a first usage mode, showing an unoccupied state.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically depicted in order to simplify the drawings.

Referring to FIGS. 1 through 4, there are shown a perspective view, a front, a top view and a side sectional view of an exercise apparatus 100 in the same state according to a first embodiment of the present invention. The exercise apparatus 100 includes a platform 10 placed on the ground, a left side frame 20 fixed on a left side of the platform 10, a right side frame 30 fixed on a right side of the platform 10, a front frame 40 fixed on a front end of the platform 10 and a restricting device 50 connected among the left side frame 20, the right side frame 30 and the front frame 40.

Figure 4:
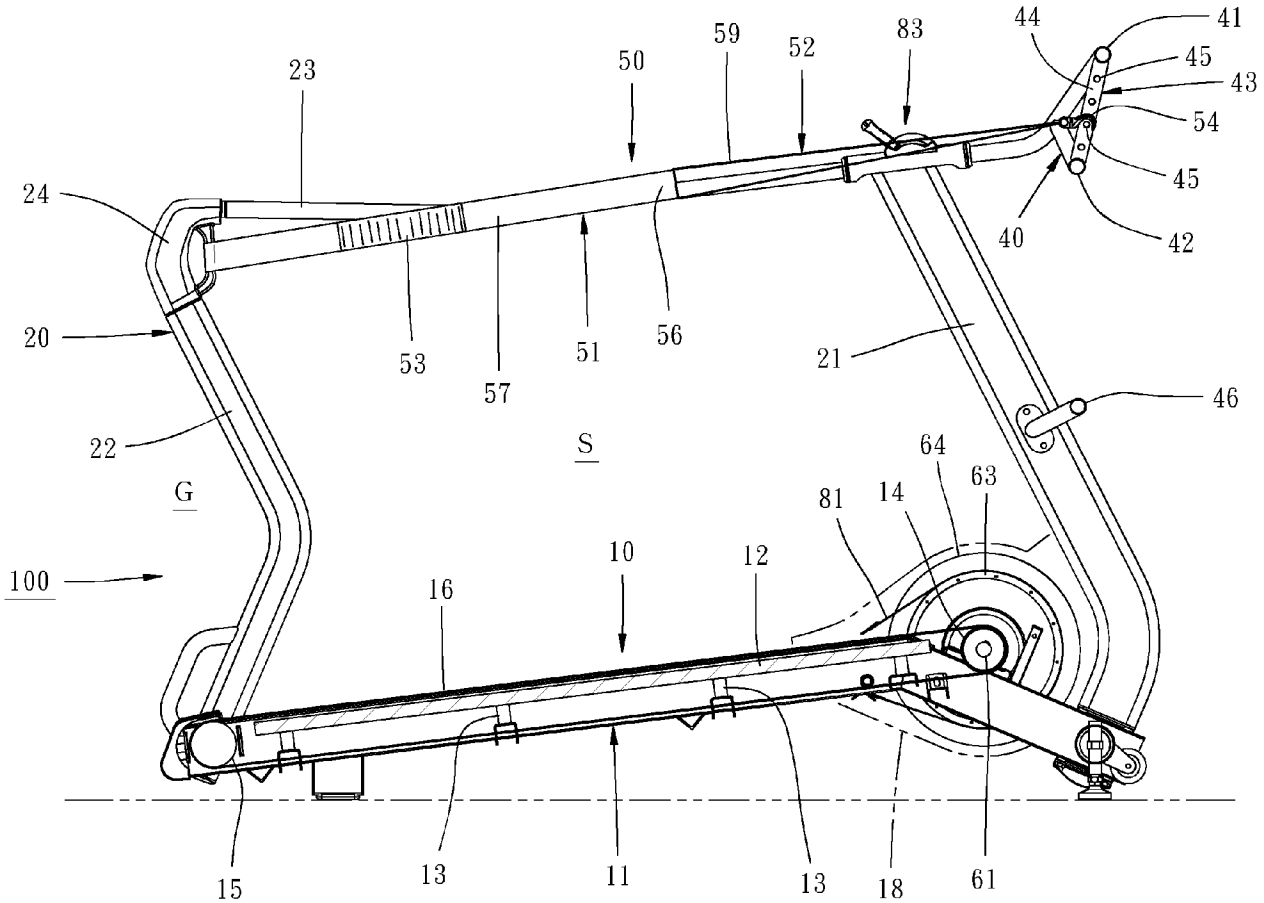
FIG. 4 is a cross-sectional view of the exercise apparatus along line IV-IV of FIG. 3, wherein parts of the outer shell are removed for showing the internal mechanism.

In the first embodiment of the present invention, the configuration of the platform 10 is similar to a platform of the conventional non-electric treadmill. As shown in FIG. 4, the platform 10 has a support frame 11 placed stably on the ground. A deck 12 is supported on the support frame 11 through a plurality of elastic support members 13. A front end of the deck 12 is higher than a rear end of the deck 12 (in the present embodiment, an elevation angle of the deck 12 relative to the ground is about 7 degrees). A front roller 14 is pivotally mounted on the support frame 11 in front of the deck 12 and a rear roller 15 is pivotally mounted on the support frame 11 in back of the deck 12. An endless belt 16 is mounted around the front roller 14, the rear roller 15 and the deck 12 so as to provide a circular plane for a user to exercise thereon. In addition to the normal platform, the platform of the present invention can also be implemented as an embodiment of the U.S. Pat. No. 8,343,016, that is, the platform of the present invention can also be implemented without a deck. Clearly, there are a plurality of rollers arranged along a left side and a right side of a treadmill frame in a longitudinal direction of the platform, and an endless belt comprising a plurality of parallel slates attached to each other. The left and right sides of the endless belt are available to slide on the rollers so that the endless belt could rotate around the treadmill frame and bear the user via the top plane of the endless belt. In short, the platform 10 is provided for allowing the user to walk, jog or run on the endless belt 16. Such exercises would promote the rotation of the endless belt 16. A flywheel 63 is coaxially fixed on a left end of the front roller 14. In addition to generating a movement resistance, the inertial force produced by the rotation of the flywheel 63 also assists the rotation of the endless belt 16. The endless belt 16 defines an exercising space S above a top plane thereof (note: the space could be regard as a cube, the length and width of the space respectively correspond to the length and width of the top plane of the endless belt 16, and its height is substantially the same as the height of a general person). Like the exercise apparatus 100, the exercising space S defines a front side, a rear side, a left side and a right side respectively corresponding to the front, rear, left and right directions of the user who exercises in the exercising space S.

Figure 5:
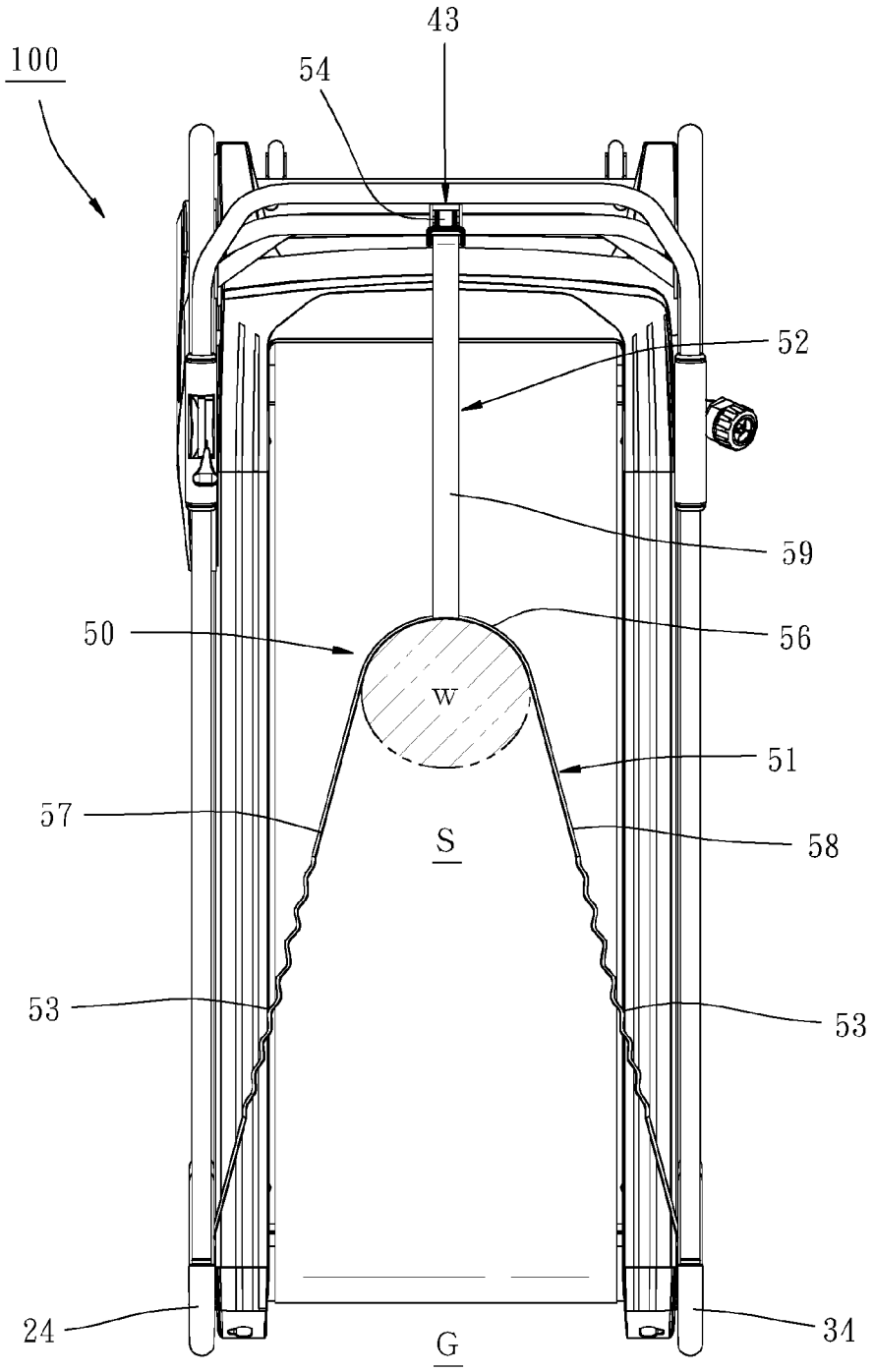
FIG. 5 is similar to FIG. 3, but illustrates a state that a user is doing running exercise.

The left side frame 20 and the right side frame 30 are respectively located at the left side and right side of the space S, and each of the side frames 20 and 30 has a front post 21 or 31, a rear post 22 or 32 and a handrail 23 or 33. The bottoms of the front posts 21, 31 of the side frames 20 and 30 are respectively secured to the left front corner and the right front corner of the support frame 11 of the platform 10. The bottoms of the rear posts 22, 32 of the of the side frames 20 and 30 are respectively secured to the left rear corner and the right rear corner of the support frame 11. Each handrail 23 or 33 is connected between the top of the respective front post 21 or 31 and the top of the respective rear post 22 or 32 at the left and right sides of the whole exercise apparatus 100, and substantially extends along the longitudinal direction of the platform 10. The height of each handrail 23 or 33 (from the top plane of the endless belt 16) is substantially the same as the waist height of a general person, for example 90 to 95 cm, and it is available for a user to hold, if necessary. At the rear end of the exercise apparatus 100, an entrance G is defined between the left and right rear posts 22, 32 for allowing the user to enter into or exit out of the exercising space S, as shown in FIGS. 4 and 5. The top end of each rear post 22 or 32 and the rear end of each corresponding handrail 23, 33 are connected by a corner member. The corner member is configured to sustain the restricting device 50 as well. The corner member at the left side of the whole exercise apparatus 100 is defined as a left rear holding portion 24. The left rear holding portion 24 is located at the left rear corner of the exercising space S. The corner member at the right side of the whole exercise apparatus 100 is defined as a right rear holding portion 34. The right rear holding portion 34 is located at the right rear corner of the exercising space S. The heights of the left rear holding portion 24 and the right rear holding portion 34 (from the top plane of the endless belt 16) are substantially the same as the waist height of the general persons.

The front frame 40 is connected between the tops of the left and right side front posts 21, 31 and located at a front side of the exercising space S. The front frame 40 has an upper rail 41 and a lower rail 42 extending in a latitudinal direction. A front holding portion 43 is connected between the upper rail 41 and the lower rail 42 at a central position of the front frame 40. The front holding portion 43 has two parallel longitudinal connecting plates 44 connected between the upper and lower rails 41, 42 and has a plurality of horizontal rods 45 sustainably vertically spaced a distance apart between the two longitudinal connecting plates 44. The location of the horizontal rods 45 substantially corresponds to the waist height of the general users (from the top plane of the endless belt 16), wherein every adjacent two of the horizontal bars 45 have a predetermined height difference therebetween.

The restricting device 50 includes a first strap 51 and a second strap 52. The first strap 51 defines a left end, a right end and a middle part therebetween. The left end and the right end of the first strap 51 is connected to the left rear holding portion 24 of the left side frame 20 and the right rear holding portion 34 of the right side frame 30 respectively. The middle part of the first strap 51 is located within the exercising space S and located at a central area between the left and right side frames 20, 30. The second strap 52 defines a front end connected to the front holding portion 43 of the front frame 40 and a rear end connected to the middle part of the first strap 51. Specifically, the first strap 51 comprises a plurality of tough straps (e.g. canvas bands and woven belt) sewn with elastic bands, and two ends thereof are respectively wrapped to connect with two vertical rods (not numbered) of the left rear holding portion 24 and the right rear holding portion 34 to define the left and right end of the first strap 51. In addition, the first strap 51 is separated into left and right halves by the middle part, and each of the left and right halves has an elastic band 53 to form an elastic section which could be stretchable in a longitudinal direction. On the other hand, the second strap 52 is made of a tough strap. The tough strap is folded up and two ends thereof are sewn together and connected to a hook 54. The hook 54 is detachably fastened on one of the horizontal rods 45 of the front holding portion 43 to define the front end of the second strap 52. The second strap 52 has a central portion of the aforementioned strap wrap around the middle part of the first strap 51 and sews together to define the rear end of the second strap 52.

Figure 2:
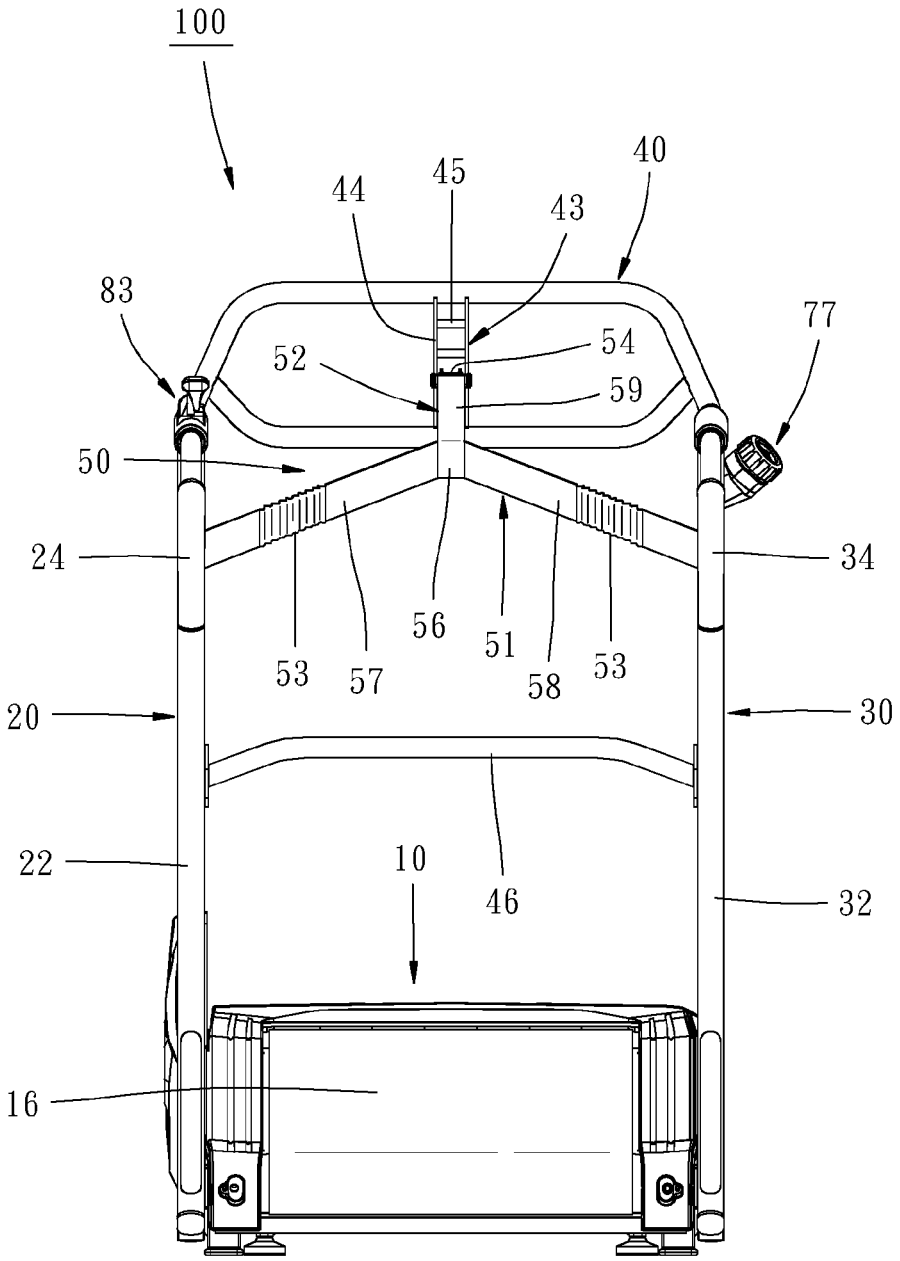
FIG. 2 is a front view of the exercise apparatus shown in FIG. 1.
Figure 3:
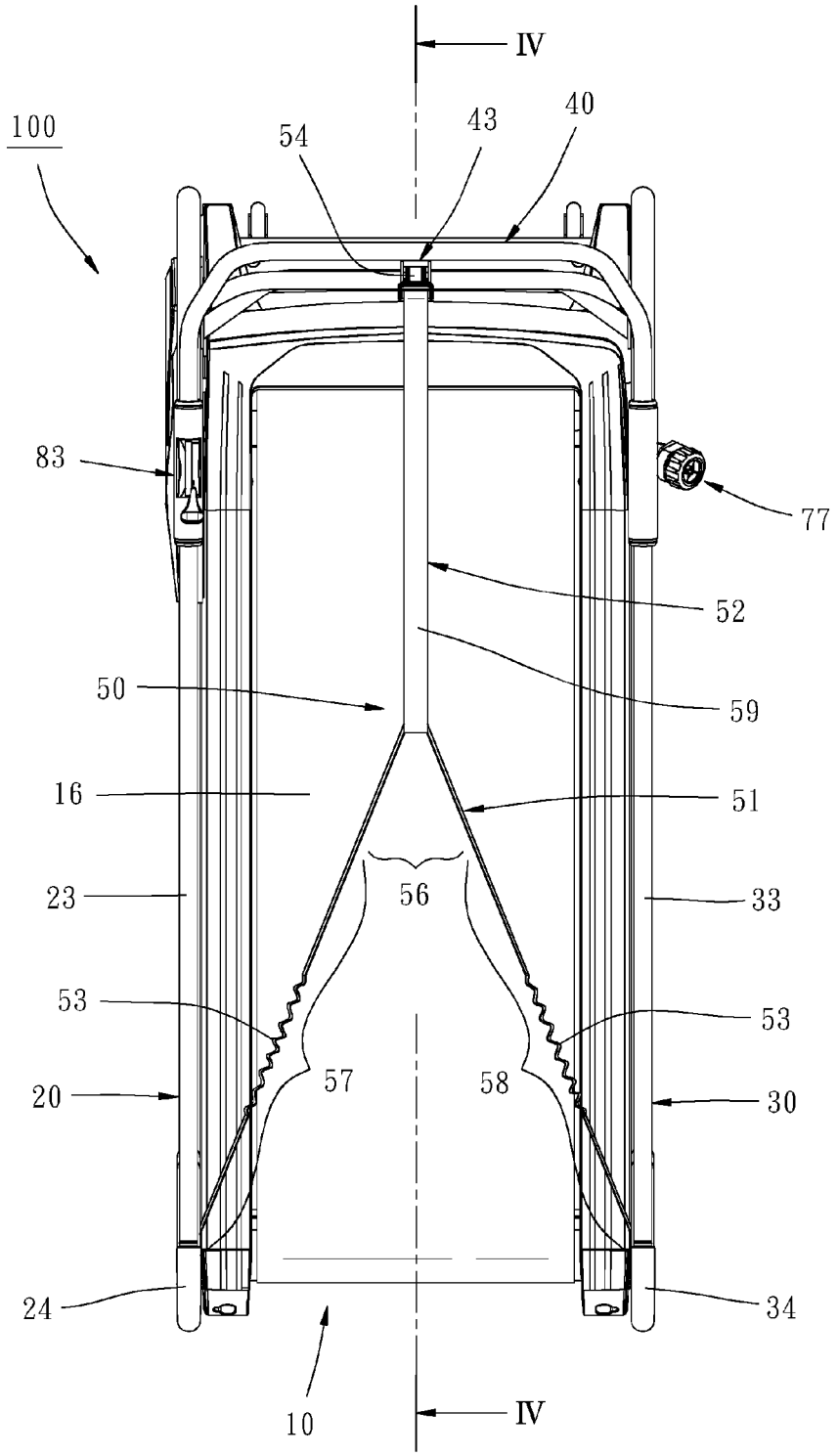
FIG. 3 is a top view of the exercise apparatus shown in FIG. 1.

As shown in FIGS. 1 through 3, the restricting device 50 with the first strap 51 and the second strap 52 is substantially Y-shaped with a branch portion facing rearward (as an inverted Y shape) while the exercise apparatus 100 is unoccupied. For short, each of the left and right halves of the first strap 51 would be shortened by a recovery force of the elastic band 53, that is, the left half of the first strap 51 would pull the middle part toward the left rear direction and the right half of the first strap 51 would pull the middle part toward the right rear direction. Therefore, the first strap 51 will pull the rear end of the second strap 52 toward the rear direction by symmetrical forces from the left and right halves, so that the second strap 52 is stretched along the longitudinal direction. Under this arrangement, the elastic band 53 still has its elasticity, but it is unable to be shortened, so that the left and right halves of the first strap 51 are linearly extended respectively. The first strap 51 defines a central area of the middle part as a retaining portion 56 (note: the central area in FIG. 3 is schematically illustrated only, so that there is no clear boundary actually). The retaining portion 56, the left restricting portion 57 and the right restricting portion 58 form a substantially V-shaped configuration with an opening toward the entrance G at the rear side as shown in FIG. 5, and it defines a left end and a right end. The first strap 51 defines a left restricting portion 57 between the left end thereof and the retaining portion 56, showing that the left restricting portion 57 extends from left rear holding portion 24 toward a right front direction and connects to the left end of the retaining portion 56, and containing an elastic band (elastic section) 53 therebetween. The first strap 51 defines a right restricting portion 58 between the right end and the retaining portion 56, showing that the right restricting portion 58 extends from the right rear holding portion 34 toward a left front direction and connects to the right end of the retaining portion 56, and also containing an elastic band (elastic section) 53 therebetween. The whole of the second strap 52 is defined as a suspension portion 59 which extends rearward from the front holding portion 43 and connects to a central position of the retaining portion 56. All in all, the retaining portion 56 of the restricting device 50 is maintained at the central area of the exercising space S by the left restricting portion 57, the right restriction portion 58 and the suspension portion 59, and located at a certain height corresponding to a waist of the user.

Figure 6:
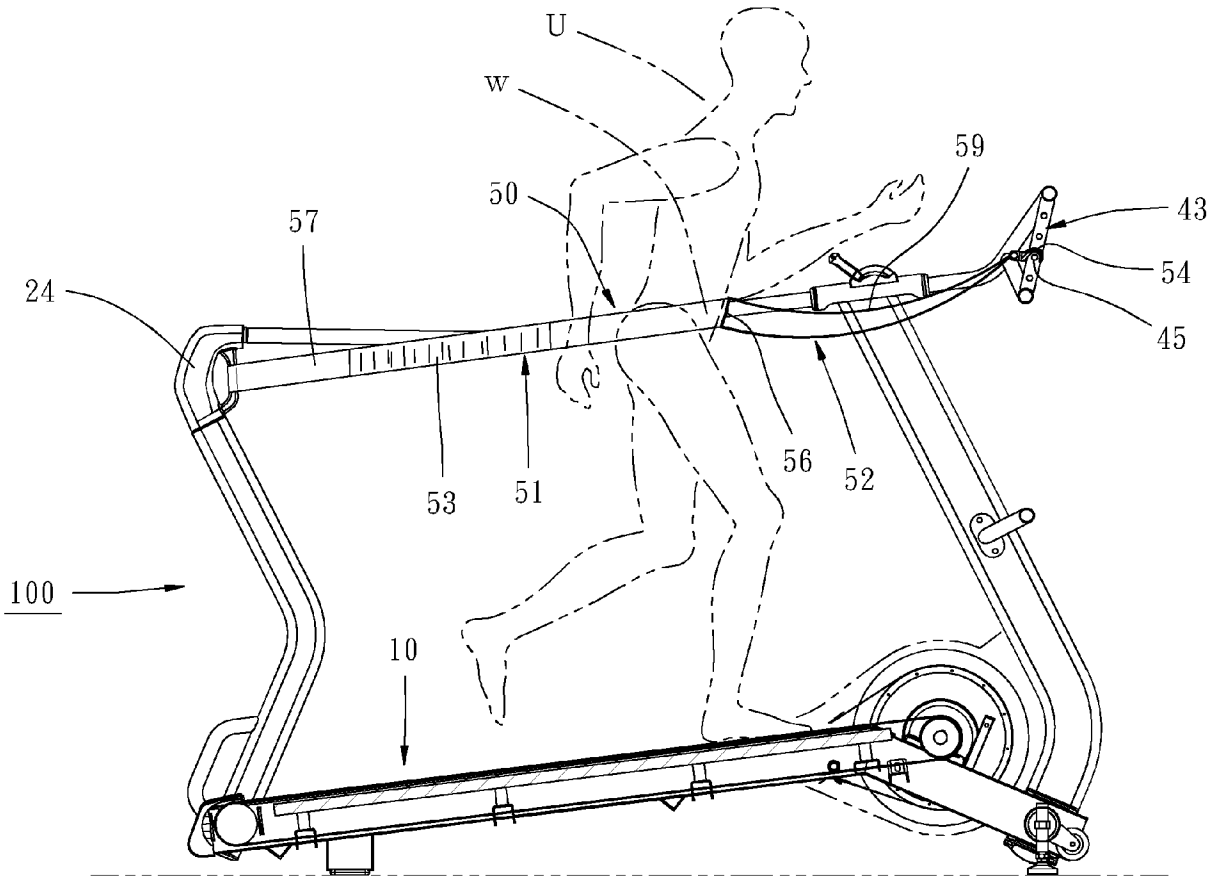
FIG. 6 is similar to FIG. 4, but illustrates the state that the user is doing running exercise.

Under this arrangement, when the user wants to walk, jog or run on the exercise apparatus 100, the user can step onto the platform 10 through the entrance G at the rear end of the exercise apparatus 100 and go forward to the central area of the exercising space S freely. Generally, the retaining portion 56 of the restricting device 50 is kept at the height corresponding to the user's waist and substantially V-shaped with the opening toward the rear side. Therefore, when the user move forward to the central area of the exercising space S, the retaining portion 56 will naturally abut against the waist of the user and be deformed in accordance with the forward pressing degree of the user. For example, the retaining portion 56 would become arcuate to perfectly fit the front side, the left side and the right side of the waist of the user, and then the user could start walking, jogging or running in this state, as shown in FIG. 5 and FIG. 6. While exercising, especially at the time that the endless belt 16 is in the state of initial running or low speed, if the forward speed corresponding to the stepping motion of the user U is greater than the surface sliding speed of the endless belt 16, the user U will move forward toward the front side of the exercising space S. In other words, the retaining portion 56 of the restricting device 50 would be pushed by the waist W of the user U. Within a certain extent, the left restricting portion 57 and the right restricting portion 58 of the restricting device 50 are elongated through the elongational elasticity of the elastic band 53 till the elastic band 53 cannot be elongated anymore, and the suspension portion 59 will naturally hang down since the distance between the front and the rear end of the suspension portion 59 is shortened at the same time. Besides, the tension will increase while the elastic band 53 is elongated such that the pulling force of the left restricting portion 57 and the right restricting portion 58 for pulling the retaining portion 56 backward would be equivalent to the forward force of the user U, and therefore the waist W of the user U would be restricted by the retaining portion 56. Thus, the waist W of the user U is unable or difficult to move forward, that is, the user U cannot continue to move forward as a whole. When the waist W of the user U slightly backs from the position that the waist W of the user U is unable or difficult to move forward, the retaining portion 56 would keep abutting against the waist W of the user U and not fall to a low place because the retaining portion 56 is pulled by the left restricting portion 57 and the right restricting portion 58 with stretch elasticity all the time. By presetting the normal length and the maximum length of each of the left restricting portion 57 and the right restricting portion 58, the whole body of the user U is located in the central area or the central front location.

As the user is pulled by the rope to restrict the forward motion in the prior art, the present invention uses the restricting device 50 to retain the waist W of the user U for restrict the forward motion. In this manner, the user could run free without hands holding a front handrail, using a reaction force from the restricting device 50 to increase the foot pushing force on the endless belt 16 for allowing the endless belt 16 beginning to slide easily from a rest condition and to keep running at a lower speed (in the walking motion). In addition, since the user U is unable to move forward relative to the platform 10, the sliding speed of the surface of the endless belt 16 will fully reflect the foot motion of the user. Therefore, the user U can move naturally for walking, jogging or running just like outdoor exercise and speed up or slow down the movement speed whenever they want to do so, during the exercise. Besides, the revolution speed of the endless belt 16 is the speed at which the user U moves, so that the user U can continue to accelerate the running speed to sprint or quick run in the individual maximum capacity thereof for high-strength training. When the exercise is finished, the user U is able to freely back away and leave the platform 10 through the entrance G. When the waist W of the user U is away from the retaining portion 56, the restricting device 50 will return to the original state. Compared to the prior art that the user is restricted by a rope on the rear side, in relation to the exercise apparatus 100 of the present invention, the user does not need to wear or take off the wearing member attaching to the end of the rope, so that it is convenient for the user to use. Furthermore, because there is no need to set additional stationary frame for securing the rope behind the platform, the exercise apparatus 100 of the present invention occupies less space.

During the time that the user U walks, jogs or runs (including quick run or sprint) on the exercise apparatus 100, the retaining portion 56 of the restricting device 50 abuts against the front, left and right sides of the user's waist W, the left restricting portion 57 and the right restricting portion 58 respectively extend backward from the left and right sides of the user's waist W, and the suspension portion 59 extends frontward from the front side of the user's waist W. Therefore, the body, two legs and two hands of the user U are not restricted and interfered by the restricting device 50 so as to move freely and naturally.

In order to improve the comfort during the usage, the retaining portion 56 of the restricting device 50 could affix a soft layer, such as foam, to an inner side thereof, and/or making the retaining portion 56 have stretch elasticity. Each of the left restricting portion 57 and the right restricting portion 58 uses the elastic band 53 to have stretch elasticity for improving the using comfort as well. With respect to the stretch elasticity of each of the two restricting portions 57, 58, the elastic band 53 could be replaced by a plurality of extension springs, or making the rear ends of the two restricting portions 57, 58 connect to the respective holding portions 24, 34 via the extension springs. However, even if the left restricting portion 57 and the right restricting portion 58 have no stretch elasticity, the restricting device 50 can still accomplish the retaining function to achieve the purpose of the present invention.

As shown in FIG. 6, the retaining portion 56 of the restricting device 50 is preferably attached to the waist of the user to minimize uncomfortableness effects on the user. Conversely, if the position of the retaining portion 56 is too high or too low, it might interfere with the movement of the user in natural motion or let the user feel uncomfortable (for example, if the position of the retaining portion 56 is too high, it may limit forward action of the upper body of the user while running; if the position is too low, it may interfere with leg lifting action). For the aforementioned exercise apparatus 100, the user is able to adjust the height of the retaining portion 56 of the restricting device 50 properly according to the height of the individual waist portion thereof or other suitable location therefor. The user can use the hook 54 at the front end of the suspension portion 59 to selectively hook one of the horizontal rods 45 with respect to different heights on the front holding portion 43 so that the vertical height of the retaining portion 56 could be adjusted. In another embodiment of the present invention, the rear end of the left restricting portion 57 and the rear end of the right restricting portion 58 of the restricting device 50 are available for the user to adjust heights thereof at the left rear holding portion 24 and the right rear holding portion 34 respectively. In regard to height adjustment of the front end and the rear end of the restricting device 50, the ends of the restricting device 50 could be selectively connected to the holding portions 43, 24, 34 at various heights, or allow the holding portions 43, 24, 34 to adjust their heights respectively with respect to the platform. Incidentally, the restricting device of the present invention is not limited to be extended on the level corresponding to the user's waist from the front end to the rear end. For example, in another embodiment of the present invention, the front end of the suspension portion of the restricting device is connected to the front frame at a height higher than the height of the user's waist; correspondingly, the rear ends of the left and right restricting portions are connected to the left side frame and the right side frame at a height lower than the height of the user's waist. Therefore, the retaining potion of the restricting device between the front end and the rear ends could be located at a height corresponding to the user's waist.

Figure 7:
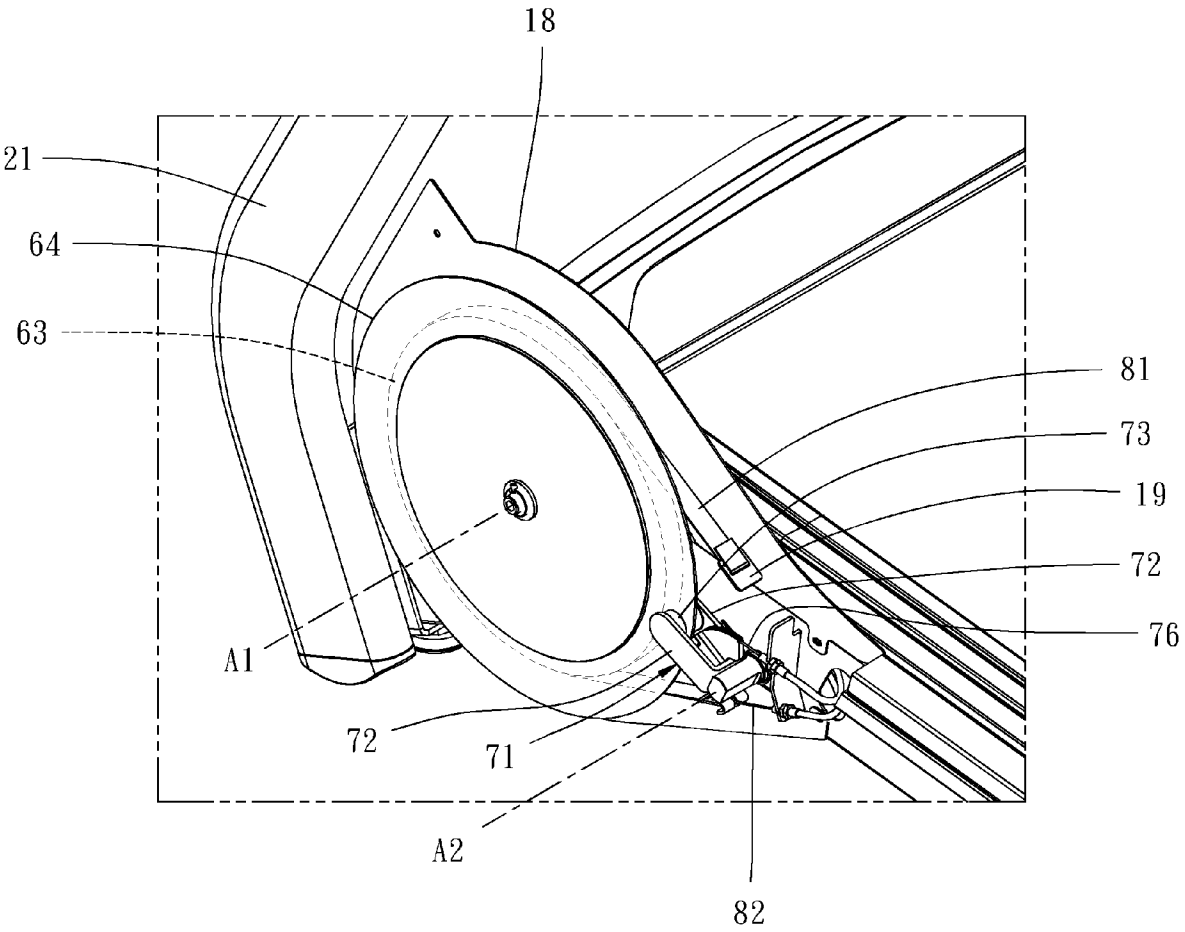
FIG. 7 is an enlarged view of a selected portion shown in FIG. 1, wherein parts of the outer shell are removed for showing the internal mechanism.
Figure 8:
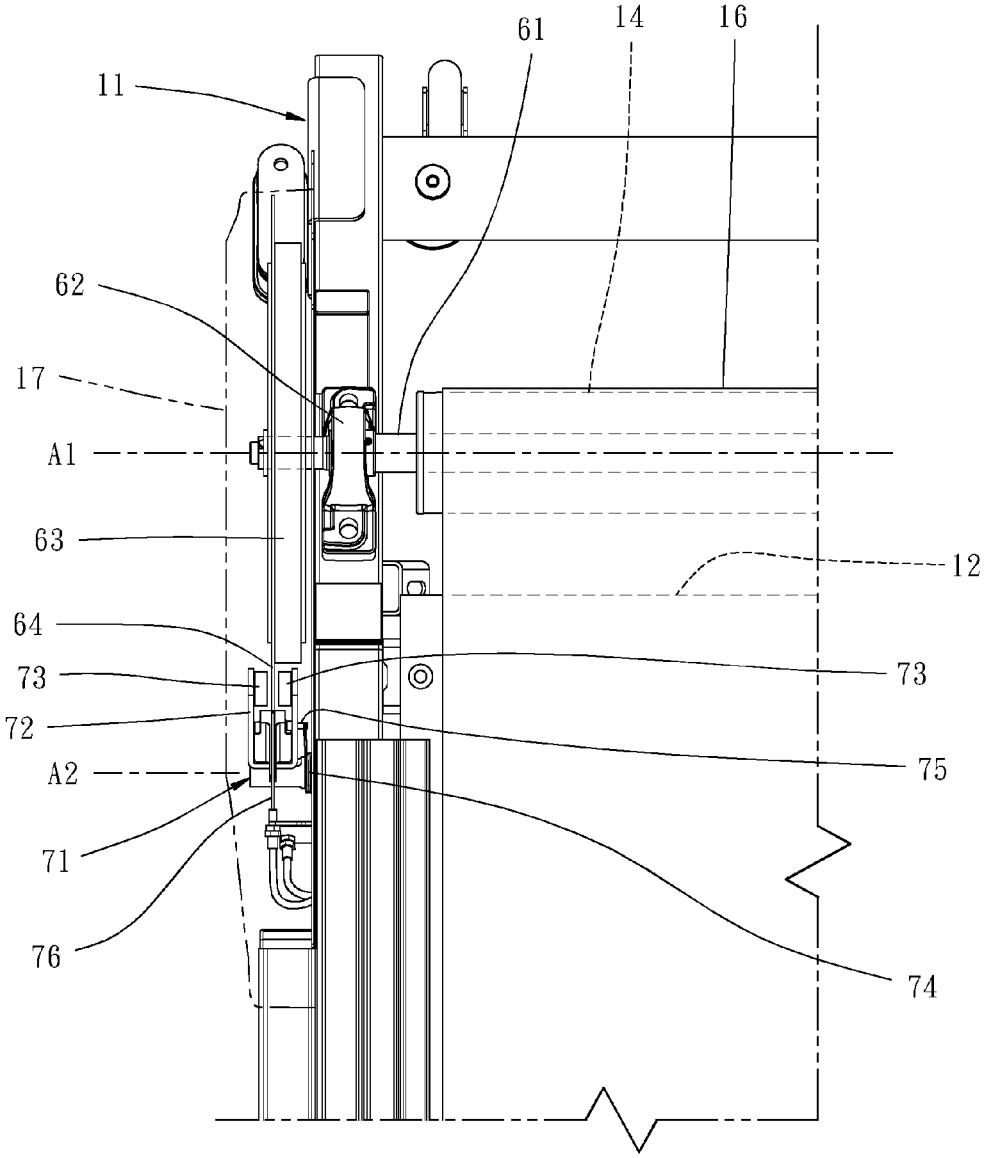
FIG. 8 is a top view for showing the left front area of the exercise apparatus in accordance with the first embodiment of the present invention, wherein parts of the outer shell are removed for showing the internal mechanism.

Like conventional non-electric treadmill, the exercise apparatus 100 also has a resistance device for adjusting the movement resistance of the endless belt 16. Referring to FIG. 4, FIG. 7 and FIG. 8, at the front end of the platform 10, the front roller 14 is coupled to a spindle 61 which passes through the axle center of the front roller 14, and two ends of the spindle 61 are pivotally mounted to the left and right sides of the support frame 11 via bearings 62, so that the front roller 14 could be in situ rotatable on the support frame 11 according to a first axis A1 in accordance with an axis of the spindle 61. The left end of the spindle 61 is projected from the respective bearing 62 and the left side of the support frame 11 and secured to the aforementioned flywheel 63. A metal disc 64 is coaxially attached to the outside surface of the flywheel 63. The outer diameter of the metal disc 64 is larger than that of the flywheel 63. In a back side of the flywheel 63 and the metal disc 64, a reluctance member 71 is pivotally mounted to the support frame 11 according to a second axis A2 in accordance with a lateral axial direction. The reluctance member 71 is rotatable between a first angular position and a second angular position with respect to the support frame 11 about the second axis A2. The reluctance member 71 has two parallel pivot arms 72 extended from the pivot portion thereof and being perpendicular to the second axis A2. The two pivot arms 72 have two magnets 73 disposed at two opposite sides of the rear ends thereof. The two magnets 73 are spaced a certain distance apart for allowing the metal disc 64 to pass through the space between the two magnets 73. A torsion spring 74 is mounted around the pivot portion of the reluctance member 71, as shown in FIG. 8. The torsion spring 74 has one end abutting against the support frame 11 and the other end abutting against a preset bolt 75 at an inner side of the reluctance member 71. The torsion spring 74 is configured to bias the reluctance member 71 toward the first angular position. A first steel cord 76 has one end connected to the reluctance member 71 and the other end connected to a controlling knob 77 (as shown in FIG. 1) at the top of the front post 31 of the right side frame 30. The controlling knob 77 (a conventional device, commonly in multi-speed bicycles) that can shorten or prolong the first steel cord 76 in stages to adjust the angle of the reluctance member 71 in stages. When the reluctance member 71 is located in the first angular position, the two magnets 73 are located above an inner side and an outer side of the metal disc 64 respectively, and an inner side of each magnet 73 faces to the metal disc 64. When the reluctance member 71 is located in the second angular position, the two magnets 73 are located above the edge of the metal disc 64, and the inner side of each magnet 73 does not face the metal disc 64 substantially. Therefore, the reluctance member 71 and the metal disc 64 constitute an eddy current brake (ECB), namely, as the reluctance member 71 is controlled at various angles, the rotation resistance of the metal disc 64 (the flywheel 63, the front roller 14 as well) would be adjusted. For aesthetic and safety, the flywheel 63, the metal disc 64, the reluctance member 71 etc. are generally covered between a housing 17 (as shown in FIG. 1) and an inner board 18 (as shown in FIG. 7).

When the endless belt 16 is pushed by the user's feet, the front roller 14 and the flywheel 63 will be rotated synchronously. The rotating inertia of the flywheel 63 offers an inertial force to the front roller 14 to make the endless belt 16 obtain additional pushing force and make the exercise motion more smooth. The user could use the controlling knob 77 to adjust the rotation resistance of the metal disc 64 (and the flywheel 63, the front roller 14 as well) to make the endless belt 16 has a predetermined exercising resistance so as to meet requirements of exercise of walking, jogging or running. For example, when the user feels that the endless belt 16 runs too fast or too slow, the user can turn the resistance up or down appropriately, or by increasing the resistance to enhance the exercise intensity for speeding up calorie consumption.

Figure 9:
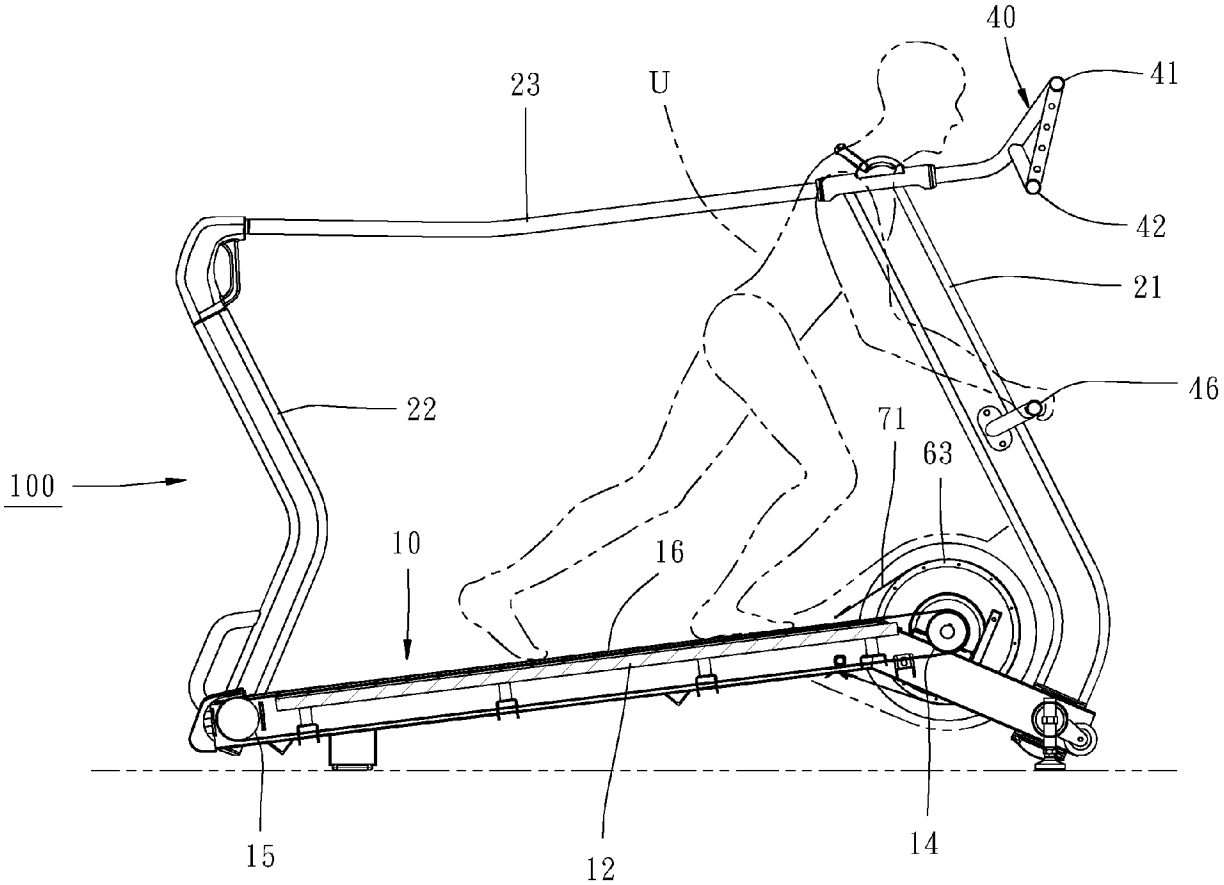
FIG. 9 is a side view of the exercise apparatus in accordance with the first embodiment of the present invention under a second usage mode for showing that the user executes a weight training.

As described above, the exercise apparatus 100 is provided for user to take an aerobic exercise, such as walking, jogging or running. Such mode of the exercise apparatus 100 is called "first usage mode" herein. In contrast, the exercise apparatus 100 also has a "second usage mode" providing for user to take a weight training that simulates a motion of pushing a weight forward. The related designs and methods are described below. Referring to FIG. 7, in addition to the aforementioned eddy current resistance, the flywheel 63 also has another resisting source, that is, the flywheel 63 has a brake band 81 mounted concentrically around most peripheral surface thereof. The brake band 81 has one end secured to the support frame 11 (in the present embodiment, one end of the brake band 81 is secured to a retaining plate 19 on the inner board 18) and the other end of brake band 81 is connected to one end of a second steel cord 82. The other end of the second steel cord 82 is connected to a lever controller 83 disposed on the top of the front post 21 of the left side frame 20. The lever controller 83 (a conventional device, commonly in multi-speed bicycles) that can shorten or prolong the second steel cord 82 in stages to adjust tightness/looseness of the brake band 81 around the flywheel 63 in stages, namely, to apply different levels of friction resistance to the flywheel 63. When the user wants to execute the foregoing weight training, the user needs to detach the restricting device 50 that is connected among the left side frame 20, the right side frame 30 and the front frame 40 such that the restricting device 50 does not occupy the exercising space S. In the present embodiment, it makes the hook 54 at the front end of the second strap 52 be detached from the front holding portion 43 of the front frame 40, and then the second strap 52, together with the first strap 51, is rested on the rear side of the exercise apparatus 100. Under the situation that the left and right ends of the first strap 51 are still connected to the left rear holding portion 24 and the right rear holding portion 34, the first strap 51 is naturally drooped in connection between the left and right rear posts 22, 32, so that it does not interfere with the entrance G to the platform 10 for the user. In another embodiment of the present invention, the front end of the suspension portion 59, the rear end of the left restricting portion 57 and the rear end of the right restricting portion 58 of the restricting device 50 are all available for the user to detachably connect to the front holding portion 43, the left rear holding portion 24 and the right rear holding portion 34. Thus, the front end, the left rear end and the right rear end of the restricting device 50 could be detached completely, if necessary. Then, the first strap 51 and the second strap 52 could be placed beside the exercise apparatus 100 or other suitable position. As shown in FIG. 9 (the detached first strap 51 and the second strap 52 are not shown in the drawing), in the second usage mode, the user U is located in the central location or the center more to the front of the exercising space S, with two hands holding on a suitable position of the front frame 40, e.g. the upper rail 41, the lower rail 42 or a grip rod 46 connected between the left and the right front posts 21, 31 at a central height, adopting a low center of gravity position, as shown in FIG. 9, and pushing the endless belt 16 with two feet of the user U so as to simulates a motion of pushing a weight forward, such as pushing sled.

In general, the largest resisting force generated by the eddy current brake (ECB) is still insufficient for being the resistance of the aforementioned weight training or fails to achieve the training effect effectively. In other words, the aforementioned weight training generally requires the use of the preceding friction resistance to provide the endless belt 16 with sufficient high resistance. Therefore, when the user is going to start the weight training, the user could ignore the setting state of the eddy current brake (ECB) and adjust the friction resistance between the brake band 81 and the flywheel 63 by the lever controller 83 to provide the endless belt 16 with appropriate resistance that the user has to overcome hard. In contrast, when the user wants to start walking, jogging or running, the user generally needs to check that the friction resistance has been adjusted to a lower level or almost released first to make the endless belt 16 could be driven by the natural motion of walking, jogging or running. If necessary, the user could use the controlling knob 77 to adjust the eddy current resistance between the reluctance member 71 and the metal disc 64, so that the endless belt 16 has appropriate resistance matching with personal desired velocity or movement difficulty. Under this arrangement, the exercise apparatus 100 has an eddy current resistance device which could be adjusted independently and a friction resistance device. For the weight training, the higher resistance could be achieved mainly by the friction resistance. Besides, it can provide a very large resistance to satisfy users with excellent physical ability or requirements of high strength training, such as athletes. In contrast, while walking, jogging or running, the relatively lower resistance could be achieved mainly by the eddy current resistance for slightly adjusting the resistance easily.

According to one aspect of the present invention, in order to make the exercise apparatus provide a choice for the user to choose one aerobic exercise such as walking, jogging or running, or to choose to simulate weigh training for pushing a weight forward. Moreover, it could easily obtain appropriate resistance whether the user takes the aerobic exercise or the weight training. The exercise apparatus of the present invention includes: a platform having a front roller, a rear roller and an endless belt mounted around above two rollers for allowing the user to walk, jog or run on the endless belt, such exercises would make the belt be revolved; a flywheel coaxially connected to the front roller; a friction resistance device disposed beside the flywheel for allowing the user to manually control the rotation resistance of the flywheel and the front roller; an eddy current resistance device disposed beside the flywheel for allowing the user to manually control the rotation resistance of the flywheel and the front roller; a front frame mounted on a front end of the platform, and having at least one holding portion for a user to grasp.

The foregoing are related instructions of the exercise apparatus 100 of the first embodiment of the present invention. Then, other preferred embodiments will be described below for illustrating any possible structures and applications of the restricting device of the present invention. The following description is mainly focused on the restricting device, and the other configurations of the exercise apparatus (e.g. platform, frame, resistance device) will not be repeated. The identical or corresponding devices/components/parts of the following embodiment in accordance with the first embodiment will be labeled with corresponding mantissa code. For example, in the first embodiment of the present invention, the left/right side frame is labeled 20/30, but in the following second, third, fourth and fifth embodiments, the left/right side frame will be labeled 220/230, 320/330, 420/430 and 520/530, or the like.

Figure 10:
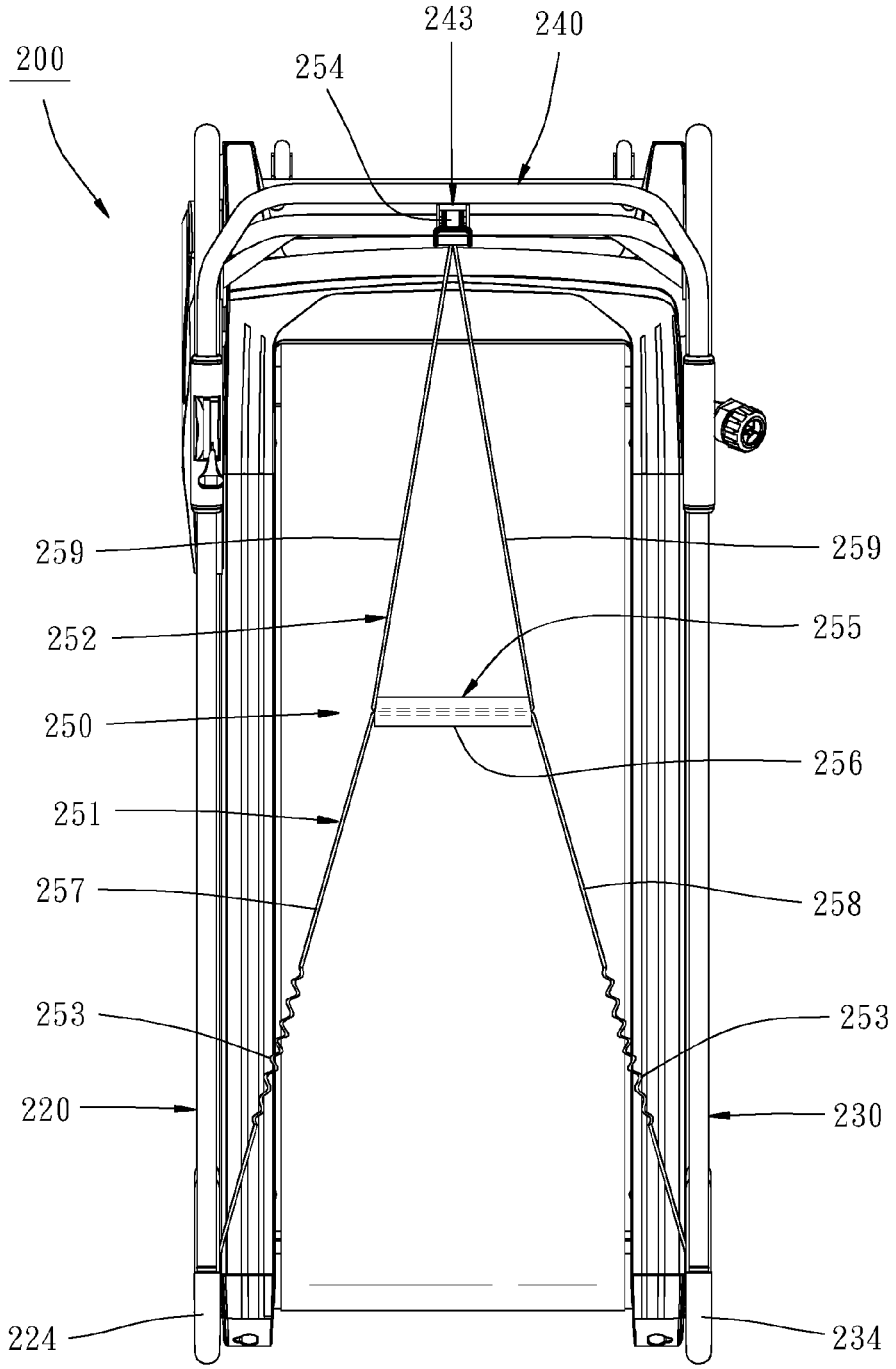
FIG. 10 is a top view of an exercise apparatus in accordance with a second embodiment of the present invention, showing an unoccupied state.
Figure 11:
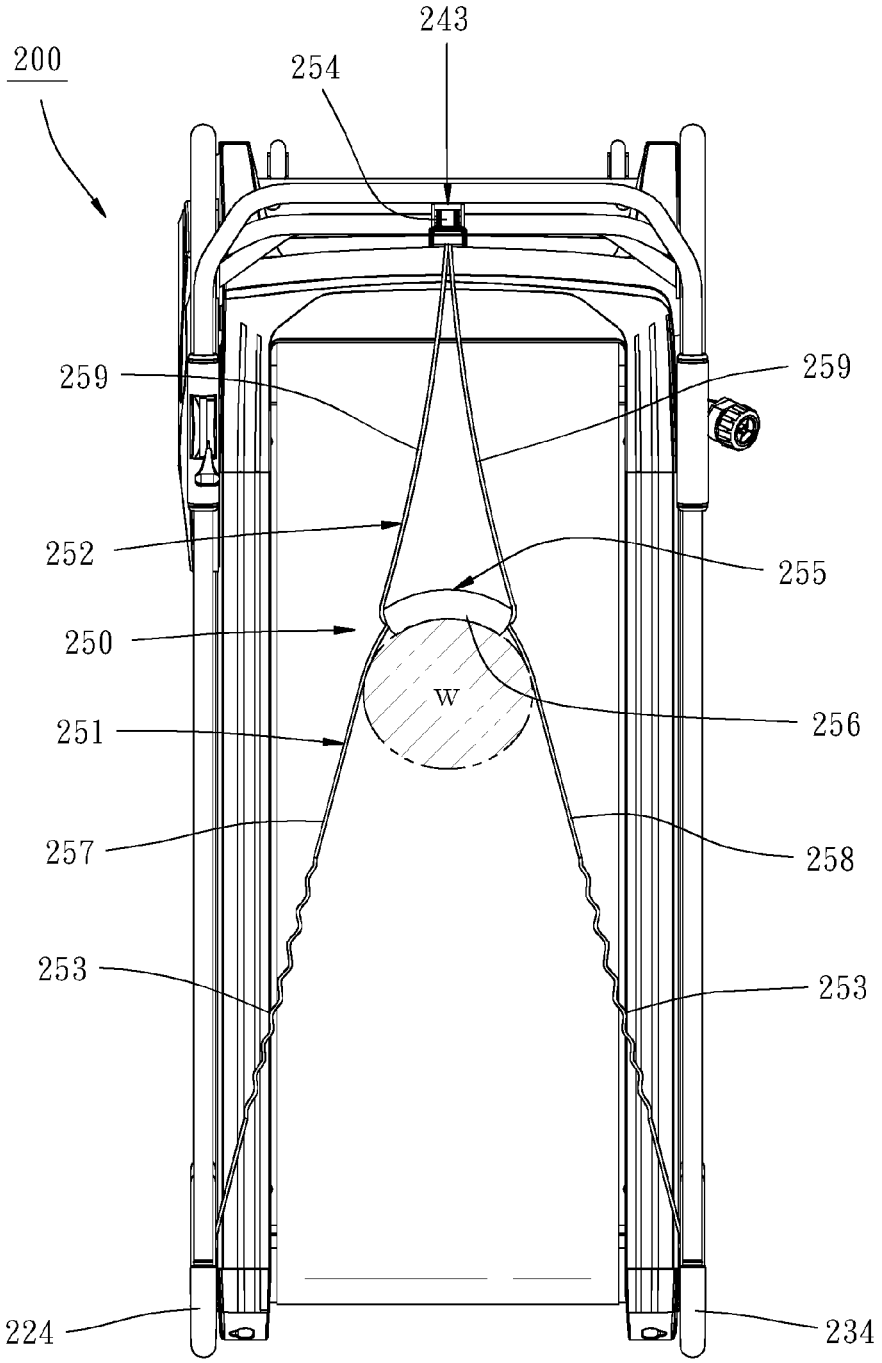
FIG. 11 is similar to FIG. 10, but illustrates a state that the user is doing running exercise.

Referring to FIG. 10, a second embodiment of the present invention is similar to the first embodiment described above. The exercise apparatus 200 has a restricting device 250. The restricting device 250 includes a first strap 251, a second strap 252 and a rectangular member 255, wherein the rectangular member 255 is located at the central area of the exercising space and has a left end and a right end. Specifically, the rectangular member 255 may be a cylindrical tube of rubber material, a rectangular soft pad filled with foam, etc. The first strap 251 is made of a plurality of tough bands (or ropes) and elastic bands (or extension springs) joined together, and has a left end and a right end. The left end and the right end of the first strap 251 are respectively secured to a left rear holding portion 224 of the left side frame 220 and a right rear holding portion 234 of the right side frame 230. Besides, the middle part of the first strap 251 passes through the rectangular member 255 from the left end to the right end. The second strap 252 is made of a tough band or a rope. The longitudinal two ends of the second strap 252 are both connected to a front holding portion 243 at a central portion. The middle part of the second strap 252 also passes through the rectangular member 255 from the left end to the right end. Under this arrangement, the rectangular member 255 is defined as the retaining portion 256 of the restricting device 250. A portion of the first strap 251 is defined as a left restricting portion 257 between the left end and the retaining portion 256, and another portion of the first strap 251 is defined as a right restricting portion 258 between the right end and the retaining portion 256 of the first strap 251. A portion of the second strap 252 is defined as a suspension portion 259 between the retaining portion 256 and either end of the second strap 252. Each of the left and right halves of the first strap 251 has an elastic band 253 which has a tendency to shorten the first strap 251, so that the rectangular member 255 would be pulled back by the first strap 251 until the two suspension portion 259 of the second strap 252 are straightened. The restricting device 250 is substantially A-shaped when not in use, wherein the retaining portion 256 is maintained at the central area of the exercising space and located at a certain height corresponding to the user's waist. As shown in FIG. 11, when the apparatus is in use, the waist W of the user would push the retaining portion 256 to move forward and make the retaining portion 256 deformed correspondingly. And further, the left and right restricting portions 257, 258 are elongated correspondingly, and the suspension portion 259 is drooped down simultaneously. Thus, the use would be retained in a position when it is unable or difficult for the user to push the retaining portion 256 to move forward.

The A-shaped structure of the restricting device 250 can also be illustrated as follows for equivalent constitution. Two longer straps are defined as left and right side of the A-shaped structure, that is, one strap is connected between the front holding portion and the left rear holding portion and the other strap is connected between the front holding portion and the right rear holding portion. Then, a shorter strap is configured to connect suitable central portions of above two longer straps to be defined as a retaining portion extending transversely.

Figure 12:
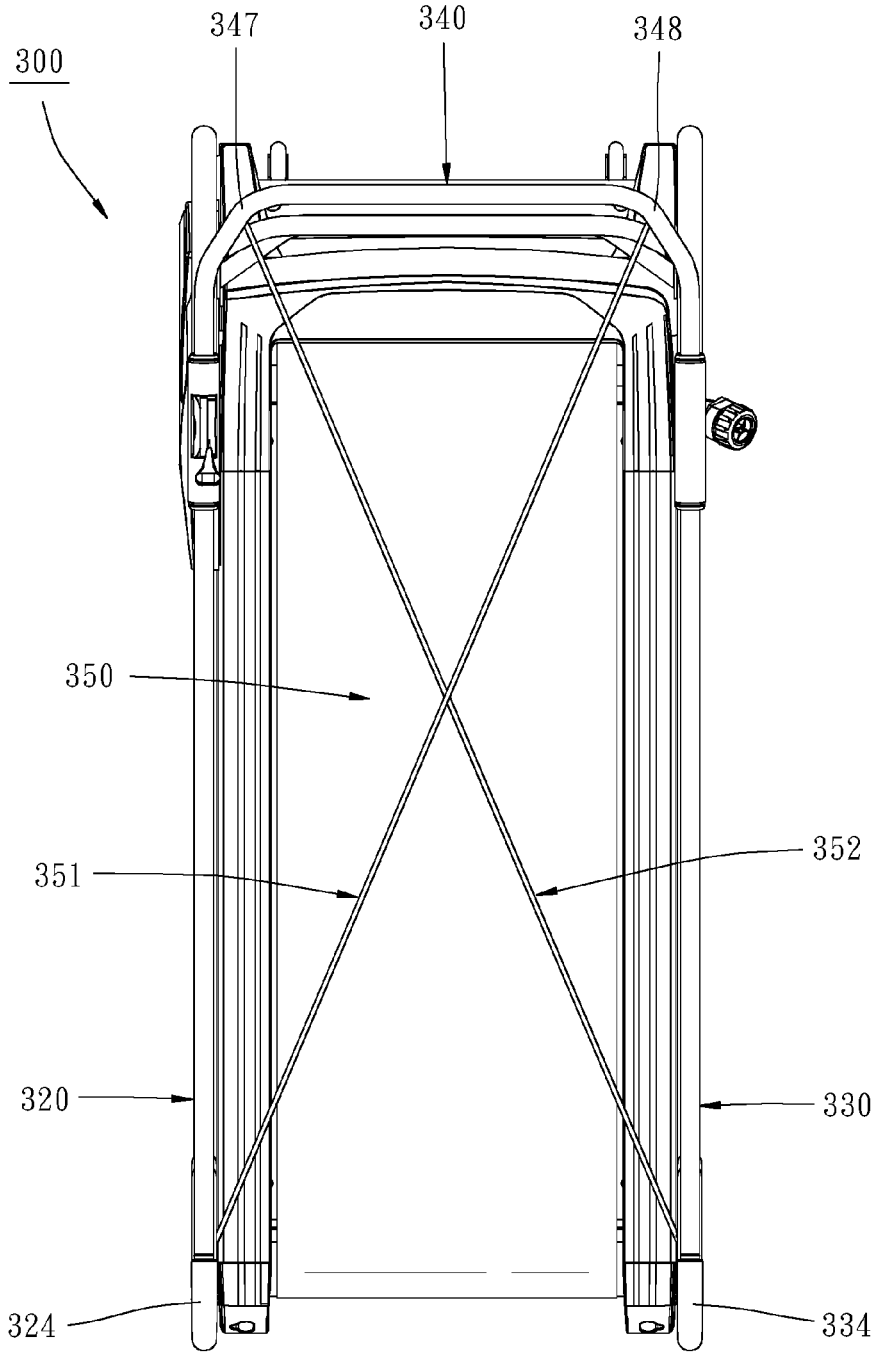
FIG. 12 is a top view of an exercise apparatus in accordance with a third embodiment of the present invention, showing an unoccupied state.
Figure 13:
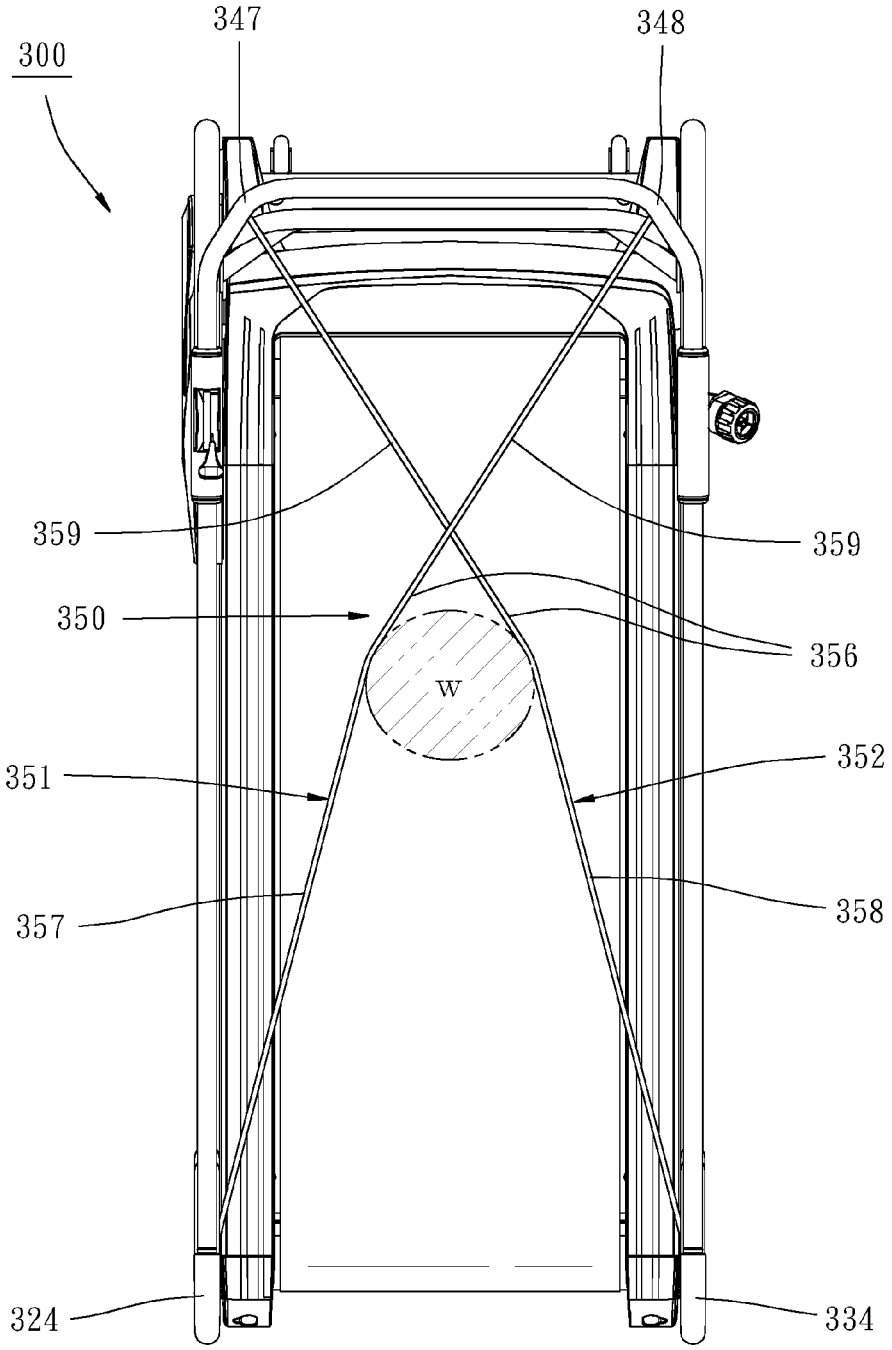
FIG. 13 is similar to FIG. 12, but illustrates a state that the user is doing running exercise.

Referring to FIG. 12, the exercise apparatus 300 in accordance with a third embodiment is described below. The front frame 340 has a left front holding portion 347 at the left front of the exercising space and a right front holding portion 348 at the right front of the exercising space. The restricting device 50 comprises a first strap 351 and a second strap 352, wherein the first strap 351 has a front end connected to the right front holding portion 348 of the front frame 340 and a rear end connected to the left rear holding portion 324 of the left side frame 320, namely, the first strap 351 connects two diagonal corners and the first strap 351 is substantially located at a height corresponding to a general user's waist. The second strap 352 also has a front end connected to the left front holding portion 347 of the front frame 340 and a rear end connected to the right rear holding portion 334 of the right side frame 330, namely, the second strap 352 connects the other two diagonal corners and the second strap 352 is also substantially located at the height corresponding to the general user's waist. The first strap 351 and the second strap 352 are crossed at the central region of the exercising space but not connected to each other. For example, in the previous crossing position, the first strap 351 and the second strap 352 are abutted against or very close to each other. The first strap 351 and the second strap 352 are made of tough bands or ropes. Although they could be flexible, they have no or only slight elongational elasticity to appropriately tighten when not in use. As shown in FIG. 13, when the waist of the user moves forward to the crossing position of the first and second straps 351, 352, the first strap 351 and the second strap 352 respectively abut against the left and right sides of the user's waist. As the user pushes forward, the first strap 351 and the second strap 352 are respectively bent outward and forward, and the crossing position will be shifted forward until the two straps are unable or difficult to be bent anymore. Thus, the waist W of the user is restricted by the first strap 351 and the second strap 352 so that the user is unable or difficult to move forward. Under this arrangement, a partial section of the first strap 351 behind the crossing position, together with a partial section of the second strap 352 behind the crossing portion, is defined as a retaining portion 356. A portion of the first strap 351 is defined as a left restricting portion 357 from the rear end to the retaining portion 356. A portion of the second strap 352 is defined as a right restricting portion 358 from the rear end to the retaining portion 356. The section of the first strap 351 between the respective front end and the crossing position, and the section of the second strap 352 between the respective front end and the crossing position are, respectively, defined as two suspension portions 359.

Figure 14:
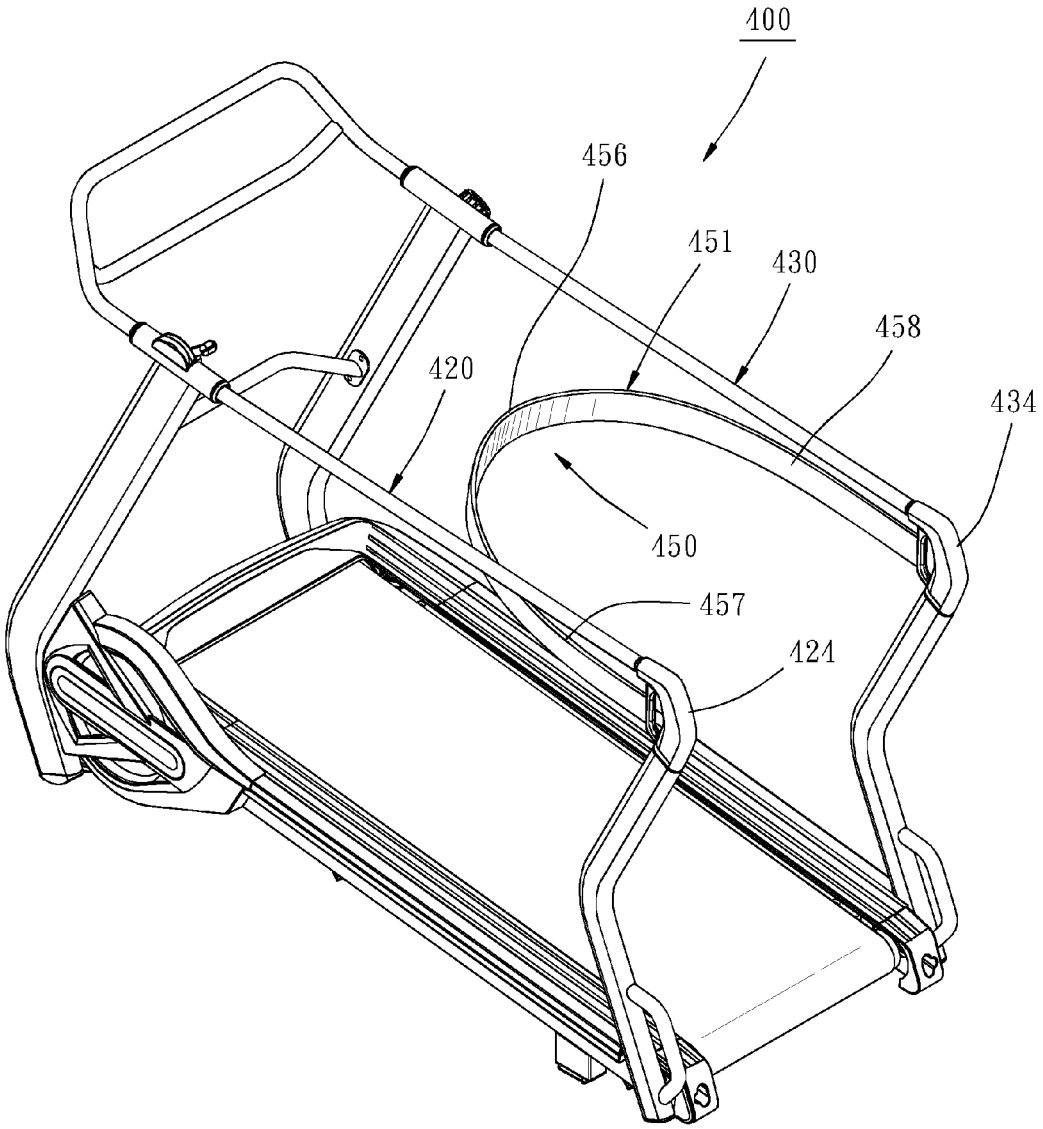
FIG. 14 is a perspective view of an exercise apparatus in accordance with a fourth embodiment of the present invention.
Figure 15:
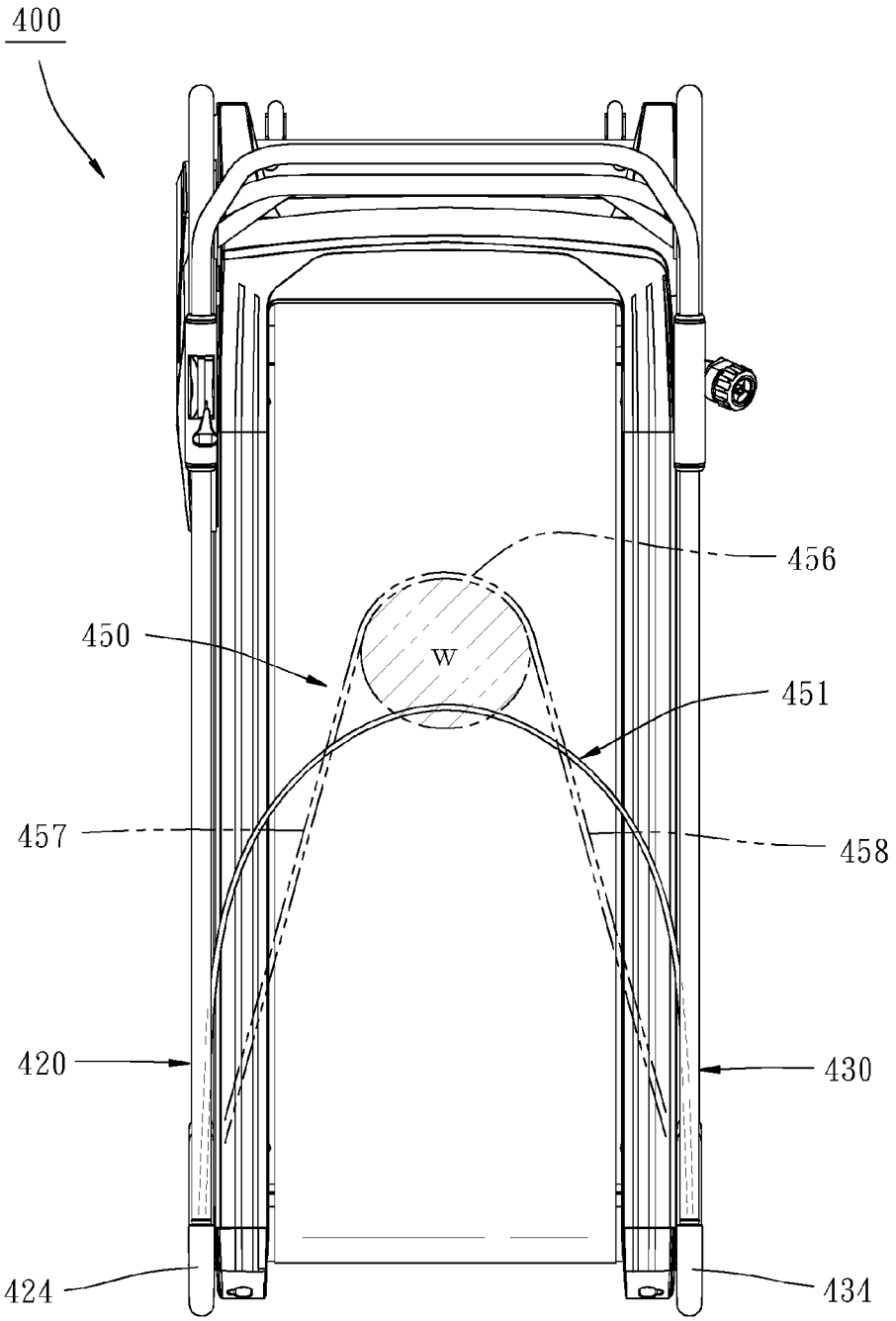
FIG. 15 is a top view of the exercise apparatus shown in FIG. 14.

The restricting devices 50, 250, 350 in the previous embodiments of which each has at least one suspension portion connected from the front frame to the retaining portion, and the suspension portion together with the left restricting portion and the right restricting portion keeps the retaining portion at a predetermined height. However, the restricting device may be designed to work without the suspension portion supported in the front, namely the restricting device could be maintained in a position for naturally abutting against the waist part of the user. One possible way is described as follows: FIGS. 14 and 15 illustrate the exercise apparatus 400 in a fourth embodiment of the present invention. The restricting device 450 has a flexible slat 451 mainly made of leather or rubber material. The flexible slat 451 has a predetermined length, width (e.g. about 5 cm) and thickness (e.g. about 0.5 cm). The flexible slat 451 could freely bend into various curves in the length direction thereof. The flexible slat 451 is generally difficult to bend in the short (width) direction. The flexible slat 451 has two longitudinal ends respectively secured to the left rear holding portion 424 of the left side frame 420 and the right rear holding portion 434 of the right side frame 430, and the short direction of the flexible slat 451 corresponds to a vertical direction. When not in use, the flexible slat 451 is arched from the left and right rear ends of the exercise apparatus 400 at the entrance to present a symmetrically arc shape. In addition, according to the width and the thickness of the flexible slat 451, the flexible slat 451 can be self-supported and not drooped down so as to maintain the flexible slat 451 at the height corresponding to the user's waist as a whole. Therefore, the middle part of the flexible slat 451 at forefront is defined as a retaining portion 456, and the left and right side regions are respectively defined as a left restricting portion 457 and a right restricting portion 458. When the user moves from the entrance at the rear end of the exercise apparatus 400 into the concave arc portion formed by the flexible slat 451 and forward to the forefront of the concave arc portion, the retaining portion 456 will be naturally against the front side of the user's waist. As the user keeps moving forward, the curved shape of the flexible slat 451 will be changed since the middle part is pushed forward by the user, until the left and right sides of the flexible slat 451 are straightened and the waist W of the user cannot move forward anymore. When the user is away from the flexible slat 451, the flexible slat 451 will be restored to the natural arc shape again.

Figure 16:
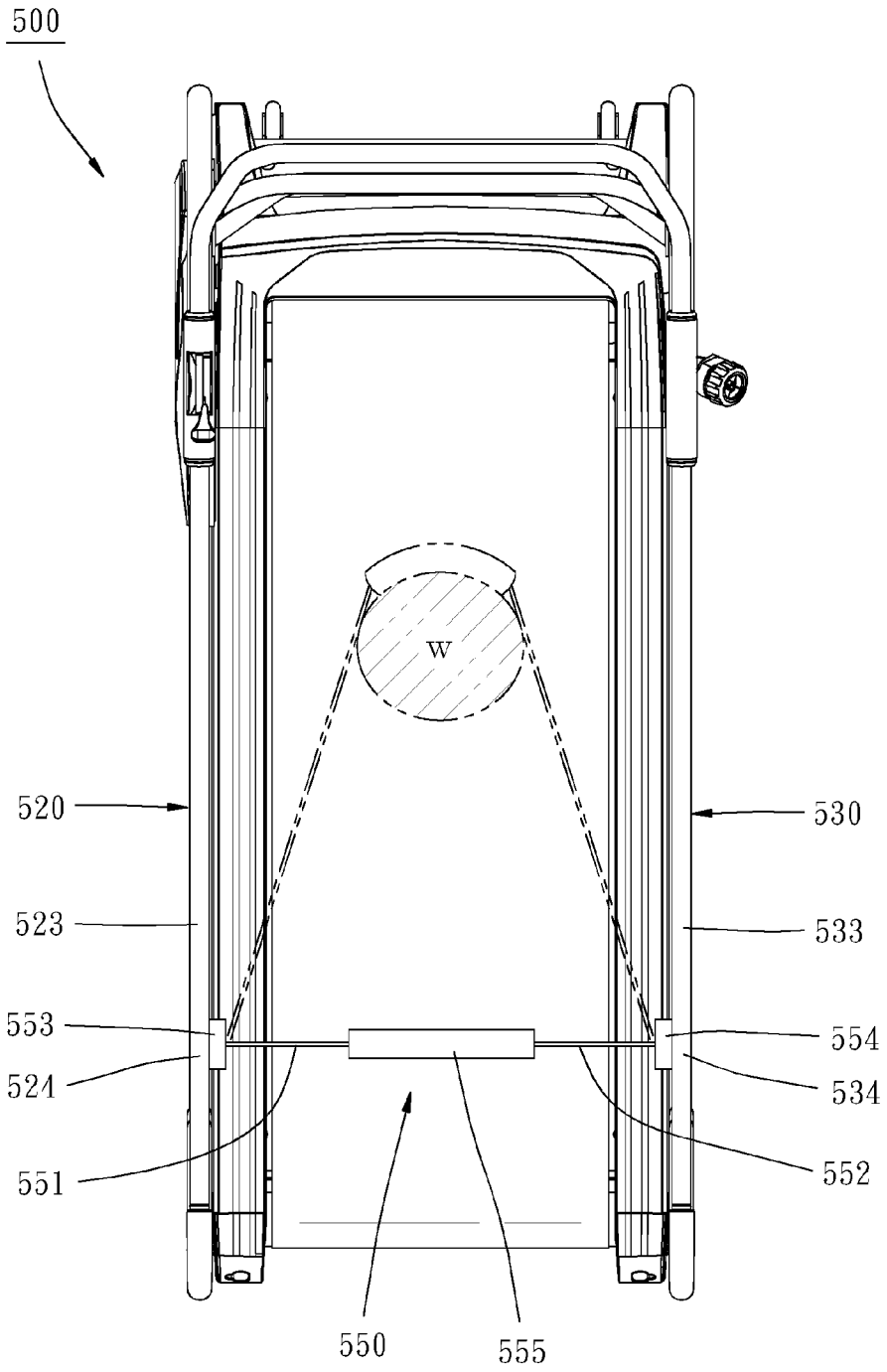
FIG. 16 is a top view of an exercise apparatus in accordance with fifth embodiment of the present invention.

Finally, referring to FIG. 16, the exercise apparatus 500 in accordance with a fifth embodiment is described below. The restricting device 550 has a rectangular member 555, a left winder 553, a right winder 554, a left cord 551 and a right cord 552. The rectangular member 555 is made of rubber strip, soft pad, or the like, and has a left end and a right end. The left winder 553 and the right winder 554 are respectively disposed at the left rear holding portion 524 of the left side frame 520 and the right rear holding portion 534 of the right side frame 530. It is noteworthy that the left rear holding portion 524 and the right rear holding portion 534 are not located in the left rear corner and the right rear corner of the exercising space, but in more forward positions which still belong to the latter portion of the exercising space at left and right side positions. For example, the appropriate positions at latter parts of the left, right handrails 523, 533 respectively replace the left rear holding portion 524 and the right rear holding portion 534. The left and right winders 553, 554 of which each has a fixing shell, a coiling drum pivotally mounted in the shell and a spiral spring with two ends connected to the coiling drum and the shell respectively (above components are not shown). The coiling drum can rotate in situ. The spiral spring is configured to bias the coiling drum in a first rotational direction. The left cord 551 has one end connected to the left end of the rectangular member 555 and the other end connected to the coiling drum of the left winder 553, wherein the cord could be coiled on the coiling drum. The right cord 552 has one end connected to the right end of the rectangular member 555 and the other end connected to the coiling drum of the right winder 554, wherein the cord could be coiled on the coiling drum. In a state without external force, the winders 553, 554 generally coil the cords 551, 552 into a shortest state so as to make the rectangular member 555 maintain in a central position at the latter portion of the exercising space and correspond to a height corresponding to a general user's waist. Under this arrangement, the rectangular member 555 is defined as a retaining portion, the left cord 551 is defined as a left restricting portion, and the right cord 552 is defined as a right restricting portion, that is, a portion of the left cord 551 is defined as the left restricting portion between the left rear holding portion 524 and the left end of the rectangular member 555, and a portion of the right cord 552 is defined as the right restricting portion between the right rear holding portion 534 and the right end of the rectangular member 555. When the rectangular member 55 is pushed forward by the waist W of the user, the left cord 551 and the right cord 552 will be drawn out from the left winder 553 and the right winder 554 respectively to make the left and right coiling drums rotate in a second rotational direction (opposite to the first rotational direction). Accordingly, the respective spiral spring will be deformed simultaneously for storing an elastic force to coil the cord. When the two cords 551, 552 are pulled to the limit, the waist W of the user is restricted by the rectangular member 555 so that the user cannot move forward anymore. When the user moves back, the rectangular member 555 will keep being against the waist W of the user until moving back to the initial position thereof via the elastic force for coiling the cords 551, 552 by the two winder 553, 554.

In another embodiment of the present invention, the rectangular member 555 and left and right cords 551, 552 could be replaced by one longer cord, namely, such cord has two ends respectively connected to the left and right winder 553, 554, and the middle part of the cord is defined as the retaining portion (as the rectangular member).

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An exercise apparatus, comprising:

a platform having an endless belt for allowing a user to exercise on the endless belt, the endless belt being driven by exercise movement of the user and defining an exercising space above the endless belt;

a left side frame located at a left side of the exercising space, and having a left rear holding portion defined at a left rear portion of the exercising space;

a right side frame located at a right side of the exercising space, and having a right rear holding portion defined at a right rear portion of the exercising space;

a front frame located at a front side of the exercising space, and having at least one front holding portion;

an entrance defined at a rear side of the exercise apparatus for allowing the user to enter into or exit out of the exercising space; and a restricting device having a retaining portion, a left restricting portion, a right restricting portion, and at least one suspension portion, the left restricting portion, the right restricting portion and the suspension portion being elongated and flexible, the left restricting portion connected between the left rear holding portion of the left side frame and a left end of the retaining portion, the right restricting portion connected between the right rear holding portion of the right side frame and a right end of the retaining portion, the suspension portion connected between the at least one front holding portion of the front frame and the retaining portion such that the retaining portion is configured to be suspended within the exercising space at a certain height corresponding to a waist of the user, the retaining portion adapted to abut against the waist of the user for resisting forward movement of the user toward the front side of the exercising space;

wherein, the retaining portion, the left restricting portion and the right restricting portion form a substantially V-shaped configuration with an opening toward the entrance of the exercise apparatus, the substantially V-shaped configuration being configured to enable the user to move forward from the entrance to abut against the retaining portion and start running without the waist of the user being encircled by the substantially V-shaped configuration.

2. The exercise apparatus as claimed in claim 1, wherein each of the left restricting portion and the right restricting portion has at least one elastic part with longitudinal elasticity.

3. The exercise apparatus as claimed in claim 1, wherein the suspension portion has a front end connected to the at least one front holding portion of the front frame for allowing the user to adjust a vertical height of the front end of the suspension portion.

4. The exercise apparatus as claimed in claim 1, wherein the suspension portion of the restricting device has a front end detachably connected to the at least one front holding portion of the front frame.

5. The exercise apparatus as claimed in claim 1, wherein the left restricting portion has a rear end detachably connected to the left rear holding portion and the right restricting portion has a rear end detachably connected to the right rear holding portion.

6. The exercise apparatus as claimed in claim 1, wherein the restricting device has a first strap and a second strap, the first strap defining a left end, a right end and a middle part therebetween, the left end and the right end of the first strap connected to the left rear holding portion of the left side frame and the right rear holding portion of the right side frame respectively, the second strap defining a front end connected to the at least one front holding portion of the front frame and a rear end connected to the middle part of the first strap, the middle part of the first strap being defined as the retaining portion, the first strap defining the left restricting portion between the left end and the middle part thereof and the right restricting portion between the right end and the middle part thereof, and the second strap being defined as the suspension portion.

* * * * *